US008960863B2

(12) United States Patent
Yamashita

(10) Patent No.: US 8,960,863 B2
(45) Date of Patent: Feb. 24, 2015

(54) LIQUID EJECTION APPARATUS AND CONNECTION METHOD FOR FLEXIBLE WIRING BOARD

(71) Applicant: Toru Yamashita, Nagoya (JP)

(72) Inventor: Toru Yamashita, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/187,405

(22) Filed: Feb. 24, 2014

(65) Prior Publication Data

US 2014/0240398 A1 Aug. 28, 2014

(30) Foreign Application Priority Data

Feb. 25, 2013 (JP) ..... 2013-034287

(51) Int. Cl.
*B41J 2/14* (2006.01)
*B41J 2/045* (2006.01)
*B41J 2/16* (2006.01)

(52) U.S. Cl.
CPC ..... *B41J 2/04541* (2013.01); *B41J 2/14233* (2013.01); *B41J 2/161* (2013.01); *B41J 2/1623* (2013.01); *B41J 2002/14491* (2013.01)
USPC ..... 347/50

(58) Field of Classification Search
CPC ..... B41J 2002/14491; B41J 2/14072; B41J 2/04541; B41J 2/14201
USPC ..... 347/40, 50, 54, 57, 58, 68
See application file for complete search history.

(56) References Cited

U.S. PATENT DOCUMENTS

| | | | | |
|---|---|---|---|---|
| 7,207,653 | B2 * | 4/2007 | Ito | 347/50 |
| 7,766,458 | B2 * | 8/2010 | Shinkai | 347/59 |
| 2006/0164468 | A1 | 7/2006 | Yoda | |
| 2006/0268074 | A1 | 11/2006 | Hori | |
| 2009/0211790 | A1 | 8/2009 | Yokouchi | |
| 2011/0018943 | A1 | 1/2011 | Owaki | |
| 2011/0205312 | A1 | 8/2011 | Miyata et al. | |

FOREIGN PATENT DOCUMENTS

| | | | |
|---|---|---|---|
| JP | 4497054 | B2 | 4/2010 |
| JP | 2010-227761 | A | 10/2010 |
| JP | 2011-25493 | A | 2/2011 |

OTHER PUBLICATIONS

European Search Report issued in EP 14155803.1, dated May 20, 2014.

* cited by examiner

*Primary Examiner* — An Do
(74) *Attorney, Agent, or Firm* — Merchant & Gould PC

(57) ABSTRACT

A liquid ejection apparatus includes a channel unit with a plurality of nozzles and pressure chambers configured to communicate with respective nozzles, and a plate provided on the channel unit to cover pressure chambers in a first direction from the pressure chambers, the plate comprising a plate surface extending along a second direction perpendicular to the first direction. The liquid ejection apparatus includes a plurality of drive elements arranged over the pressure chambers. The liquid ejection apparatus includes a plurality of contact terminals electrically connected to their respective drive elements at a terminal placement surface which is non-parallel with the plate surface and includes a portion of the terminal placement surface that is offset from the plate surface. The liquid ejection apparatus includes a flexible wiring board configured to be electrically connected to the contact terminals.

27 Claims, 20 Drawing Sheets

LIQUID EJECTION APPARATUS AND CONNECTION METHOD FOR FLEXIBLE WIRING BOARD

CROSS-REFERENCE TO RELATED APPLICATION

This application claims priority from Japanese Patent Application No. 2013-034287 filed on Feb. 25, 2013, which is incorporated herein by reference in its entirety.

FIELD OF DISCLOSURE

The disclosure herein relates to a liquid ejection apparatus and a connection method for a flexible wiring board.

BACKGROUND

A known liquid ejection apparatus (e.g., a liquid droplet ejection head) includes a nozzle plate having nozzles formed thereon, a channeled substrate including channels, e.g., pressure chambers configured to fluidly communicate with the corresponding nozzles, and piezoelectric elements to eject ink from the corresponding nozzles.

In the known liquid ejection apparatus, a vibration plate is provided on the channeled substrate to cover the pressure chambers. The piezoelectric elements are provided on the vibration plate to oppose the corresponding pressure chambers. A seal portion configured to cover the piezoelectric elements is provided on the vibration plate. The piezoelectric elements are sealed from an external space by the seal portion.

Each piezoelectric element includes an individual electrode (e.g., an upper electrode film). A connection terminal is connected to each individual electrode of the piezoelectric elements. The connection terminal extends from the piezoelectric element to an exterior of the seal portion in a surface of the vibration plate. A flexible wiring board or flexible printed circuit board on which a drive circuit is mounted, is connected to the connection terminals provided on a surface of the vibration plate in correspondence with respective piezoelectric elements. The drive circuit is configured to apply voltage to the respective piezoelectric elements, via wirings of the flexible wiring board, based on an instruction from an external controller.

To ensure electrical connection between the connection terminals and the flexible wiring board when the connection terminals are connected to the flexible wiring board by pressing the flexible wiring board against the connection terminals, each connection terminal needs to have a certain area. In a structure in which the connection terminal extending from each piezoelectric element is provided on a surface of the vibration plate, a greater surface area may be required for the vibration plate to ensure that sufficient area is provided for the connection terminals. However, this additional surface area will lead to increase in the size of the liquid ejection apparatus. Especially, in the field of printers, there is a trend to increase the number of nozzles recently. In association with the trend, the numbers of the piezoelectric elements and the connection terminals are increased, which will lead to further increase in the size of the liquid ejection apparatus.

SUMMARY

Aspects of the disclosure relate to a liquid ejection apparatus that may realize reduction in the size of the liquid ejection apparatus while maintaining an area for each connection terminal.

According to an aspect of the present teaching, there is provided a liquid ejection apparatus. The liquid ejection apparatus includes a channel unit including a liquid channel comprising a plurality of nozzles, and a plurality of pressure chambers configured to communicate with respective nozzles. The liquid ejection apparatus also includes a plate provided on the channel unit to cover the plurality of the pressure chambers in a first direction from the pressure chambers, the plate comprising a plate surface extending along a second direction perpendicular to the first direction. The liquid ejection apparatus also includes a plurality of drive elements arranged over the plate in correspondence with the plurality of the pressure chambers, and a plurality of contact terminals electrically connected in correspondence with respective drive elements, the plurality of the contact terminals are provided at a terminal placement surface, wherein the terminal placement surface is non-parallel with the plate surface and includes at least a portion of the terminal placement surface that is offset from the plate surface. The liquid ejection apparatus further includes a flexible wiring board configured to be electrically connected to the plurality of the contact terminals.

In a further aspect, a method for connecting a flexible wiring board to a liquid ejection apparatus is disclosed. The method includes connecting a flexible wiring board to each of a plurality of the contact terminals disposed on a terminal placement surface such that the flexible wiring board is pressed against the terminal placement surface in a direction normal to the terminal placement surface. The terminal placement surface is non-parallel with a plate surface of a plate provided on a channel unit and includes at least a portion of the terminal placement surface that is offset from the plate surface, wherein the channel unit including a plurality of nozzles and a plurality of pressure chambers and wherein each of the plurality of contact terminals are electrically connected to corresponding drive elements arranged over the plate in correspondence with the plurality of pressure chambers.

In a still further aspect, a printer includes a liquid ejection apparatus. The liquid ejection apparatus includes a channel unit comprising a liquid channel including a plurality of nozzles and a plurality of pressure chambers configured to communicate with respective nozzles, and a plate provided on the channel unit to cover the plurality of the pressure chambers in a first direction from the pressure chambers, the plate comprising a plate surface extending along a second direction perpendicular to the first direction. The liquid ejection apparatus further includes a plurality of drive elements arranged over the plate in correspondence with the plurality of the pressure chambers. The liquid ejection apparatus also includes a plurality of contact terminals electrically connected in correspondence with respective drive elements, the plurality of the contact terminals are provided at a terminal placement surface, wherein the terminal placement surface is non-parallel with the plate surface and includes at least a portion of the terminal placement surface that is offset from the plate surface. The liquid ejection apparatus includes a flexible wiring board configured to be electrically connected to the plurality of the contact terminals.

BRIEF DESCRIPTION OF THE DRAWINGS

Reference is made to the following description taken in connection with the accompanying drawings, like reference numerals being used for like corresponding parts in the various drawings.

DETAILED DESCRIPTION

Figure 1:
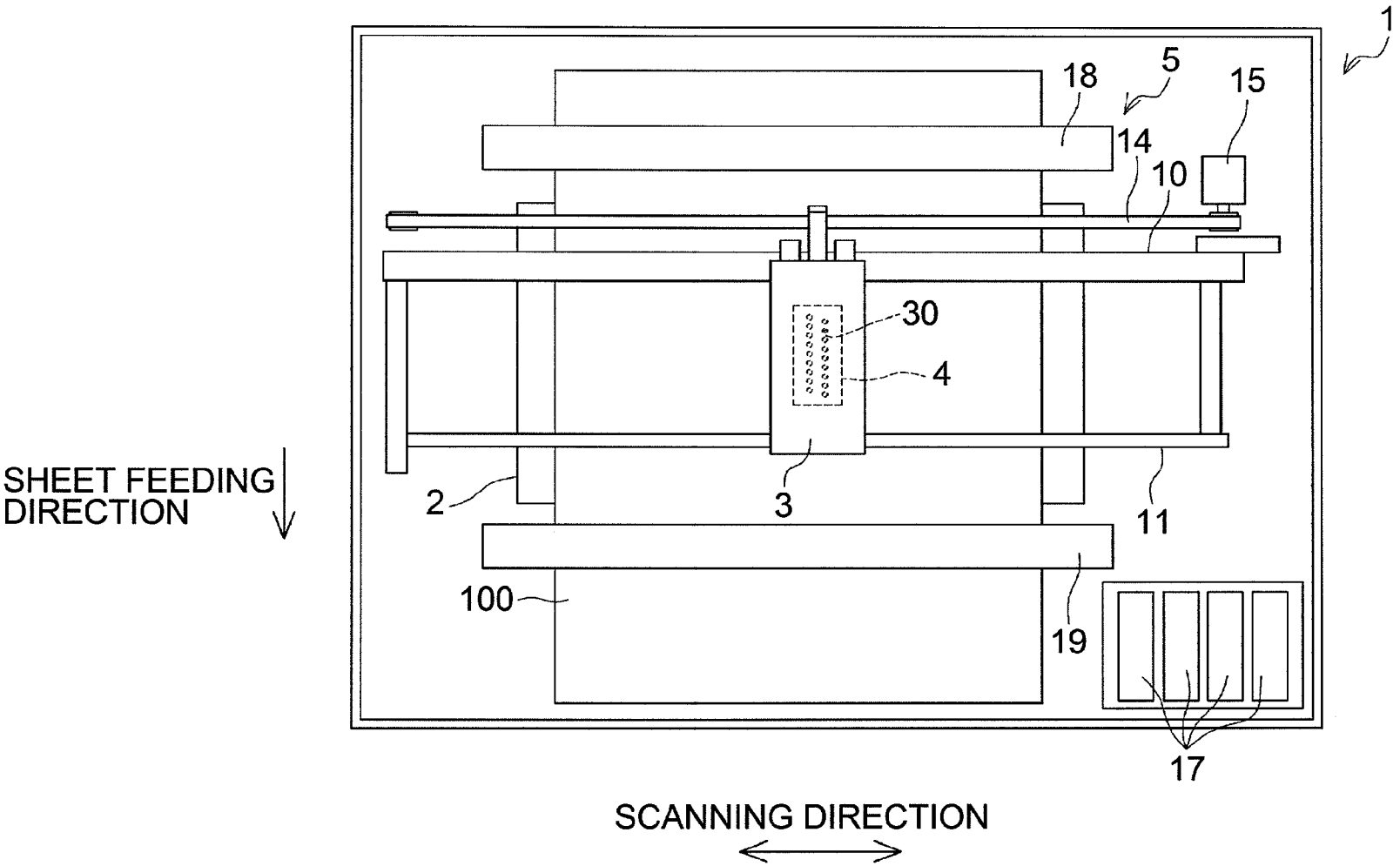
FIG. 1 is a plane view of an inkjet printer in an example embodiment according to one or more aspects of the disclosure.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general, the present disclosure relates generally to a liquid ejection apparatus and a connection method for a flexible wiring board, such as can be used in an inkjet printer. In particular, in a liquid ejection apparatus, and methods, according to example aspects of the disclosure, a terminal placement surface is non-parallel with the plate surface and includes at least a portion of the terminal placement surface that is offset from the plate surface. This terminal placement surface may be an inclined surface or a curved surface. When projected areas of an inclined surface, a curved surface, and a flat surface parallel to the plate are all same when viewed from a direction perpendicular to the plate, surface areas of the inclined surface and/or the curved surface may greater than the surface area of the flat surface. Therefore, the size of the terminal placement surface in a third direction may be reduced while a certain area may be ensured for each contact terminal. Accordingly, the size of the liquid ejection apparatus may be reduced. In other words, by disposing the terminal placement surface non-parallel with and offset from the plate surface, adequate surface area for electrical and physical connection of the flexible wiring board can be accomplished while maintaining a compact size of the overall liquid ejection apparatus.

In an example embodiment, the aspects of the disclosure may be applied to an inkjet printer 1. The top of the inkjet printer 1 may be positioned on a front side of the sheet of FIG. 1, e.g., a side of the sheet of FIG. 1 facing toward you. The bottom of the inkjet printer 1 may be positioned on a rear side of the sheet of FIG. 1. The disclosure may be described in connection with the top and bottom direction, as defined above.

In the example shown in FIG. 1, the inkjet printer 1 includes a platen 2, a carriage 3, and a liquid ejection apparatus, e.g., an inkjet head 4. The inkjet printer 1 also includes, in this embodiment, a transporting mechanism 5.

In this example embodiment, the platen 2 is configured to support a recording medium, e.g., a recording sheet 100, on an upper surface thereof. The carriage 3 is configured to reciprocate in a scanning direction along two guide rails 10, 11 in an area to oppose the platen 2. An endless belt 14 may be connected to the carriage 3. A carriage drive motor 15 may drive the endless belt 14 to move the carriage 3 along the scanning direction.

As shown in the example of FIG. 1, the inkjet head 4 is mounted on the carriage 3. The inkjet head 4 may be configured to move together with the carriage 3 along the scanning direction. The inkjet head 4 may be connected to ink cartridges 17 installed in the printer 1, via a tube (not depicted). The inkjet head 4 includes nozzles 30 formed on a lower surface thereof (e.g., the rear side of the sheet of FIG. 1). The inkjet head 4 is configured to eject ink, which is supplied from the ink cartridge 17, from the nozzles 30 onto the recording sheet 100 placed on the platen 2.

In at least some embodiments, the transporting mechanism 5 may comprise feeding rollers 18, 19 that may be disposed to interpose the platen 2 therebetween in a sheet feeding direction. The transporting mechanism 5 may be configured to feed the recording sheet 100 placed on the platen 2 by the feeding rollers 18, 19 in the sheet feeding direction.

In example embodiments, the inkjet printer 1 is configured to eject ink from the inkjet head 4 mounted on the carriage 3 onto the recording sheet 100 placed on the platen 2 while moving the carriage 3 along the scanning direction. The feeding rollers 18, 19 may feed the recording sheet 10 in the sheet feeding direction by a predetermined amount. An ink ejection operation by the inkjet head 4 and a feeding operation of the recording sheet 100 by the transporting mechanism 5 may be alternately and repeatedly performed, to print, for example, an image on the recording sheet 100.

Figure 2:
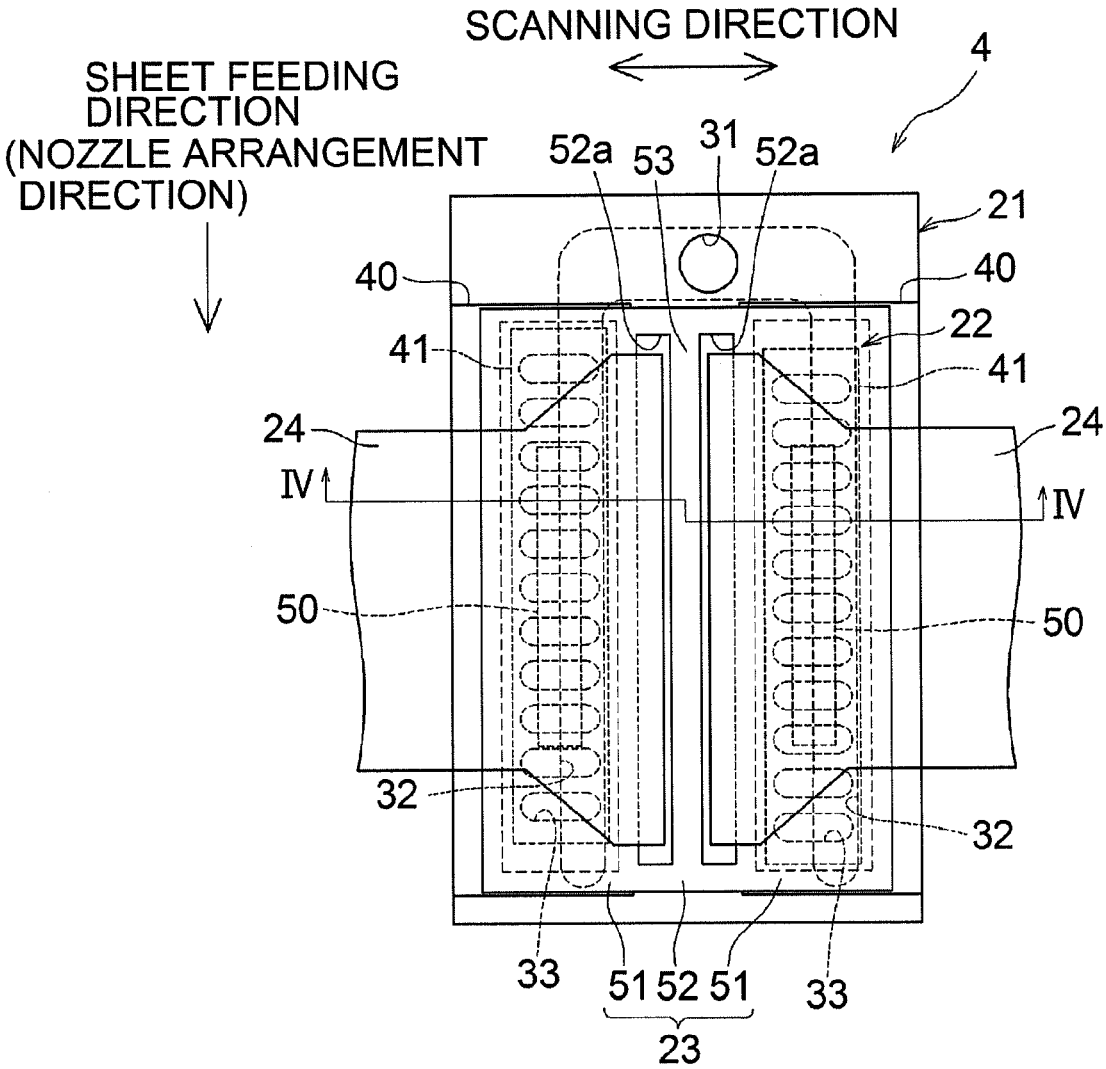
FIG. 2 is a plane view of an inkjet head of the inkjet printer of FIG. 1, according to an example embodiment.
Figure 3:
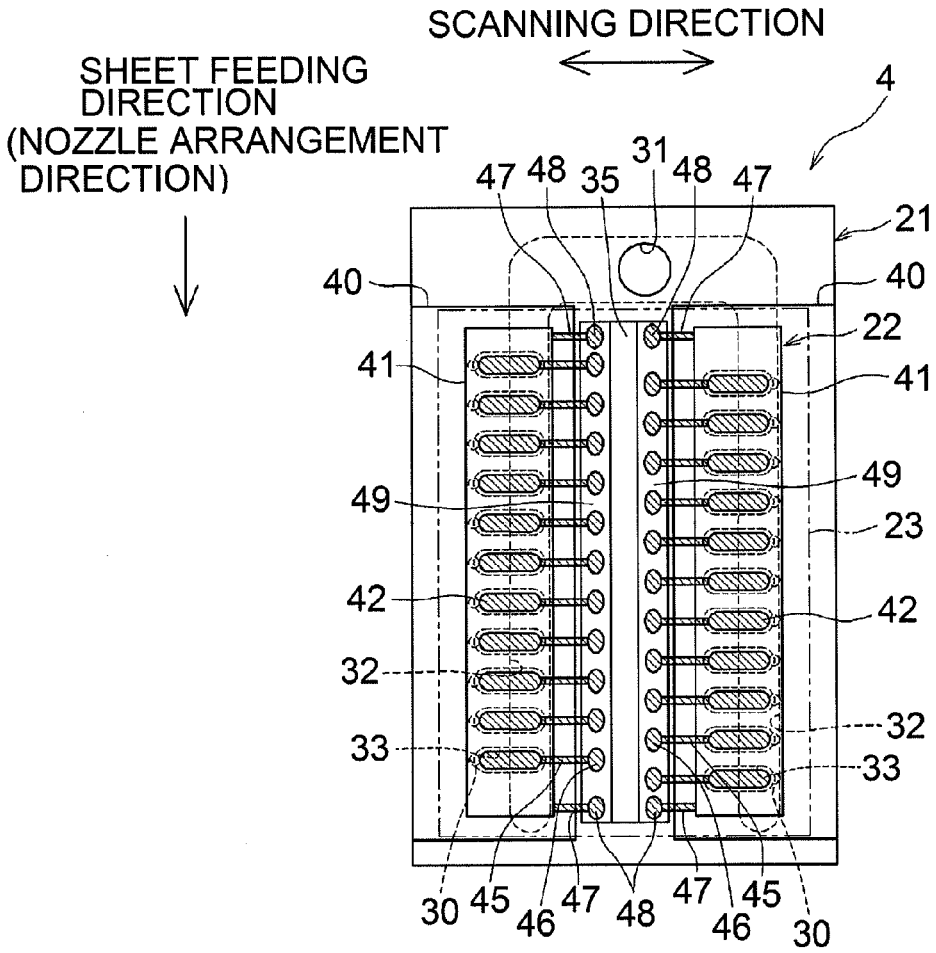
FIG. 3 is a plane view of the inkjet head of FIG. 2 in which a cover member and a chip on film ("COF") are omitted.
Figure 4A:
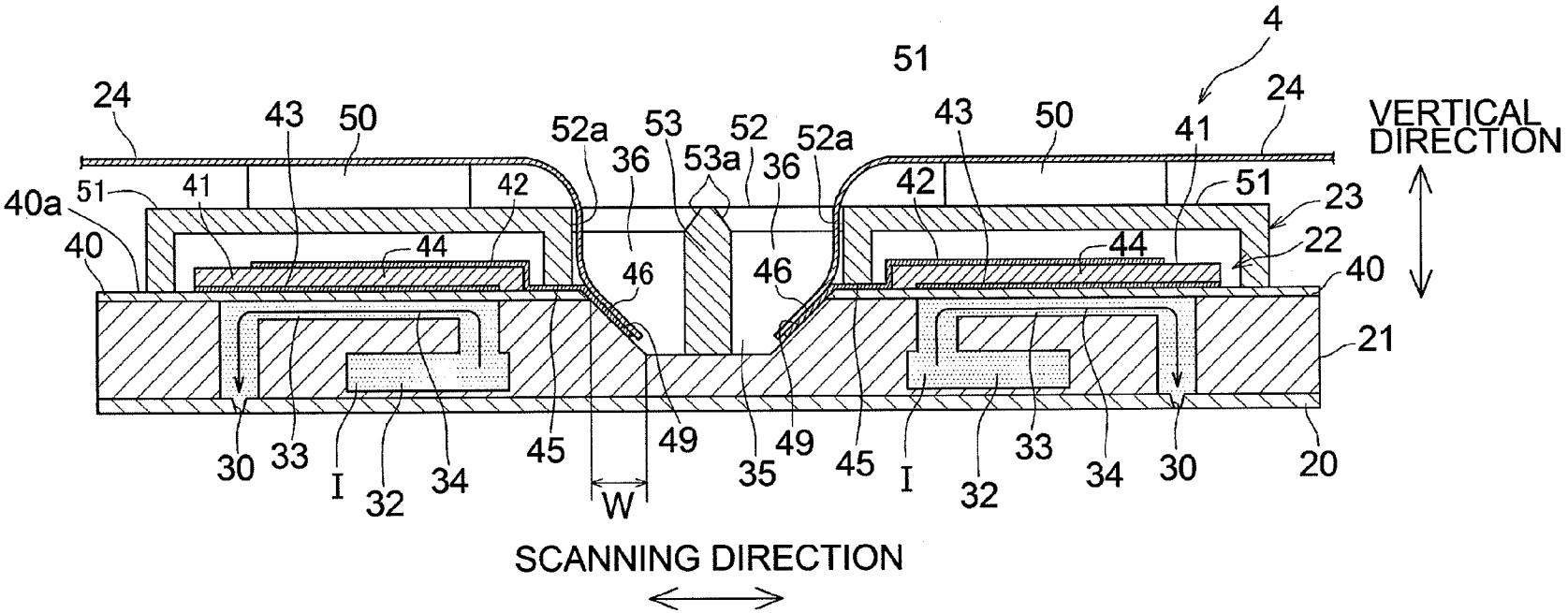
FIG. 4A is a cross-sectional view of the inkjet head of FIG. 2, taken along a line IV-Iv.

As depicted in the example embodiment shown in FIGS. 2-4, the inkjet head 4 includes a nozzle plate 20, a channeled member 21, a piezoelectric actuator 22, a cover member 23, and a wiring member, e.g., a chip on film ("COF") 24. In FIG. 3, an outline of a possible position of the cover member 23 depicted in FIG. 2 is shown via a chain double-dashed line, and the COF 24 is omitted. Letter "I" in FIG. 4A represents a possible location of ink in an ink channel formed in the channeled member 21 and the nozzle plate 20.

As depicted in the example of FIG. 4A, the nozzle plate 20 may be a plate member constructed from any of a number of materials, such as, for example, a synthetic resin, e.g., polyimide, or metallic material. In this example, the nozzle plate 20 includes the nozzles 30 passing therethrough in its thickness direction (e.g., a first direction). As depicted in FIG. 3, the nozzles 30 may be arranged in two arrays along a sheet feeding direction, such as is shown in FIGS. 1-3, and is approximately normal to the vertical direction and the scanning direction as seen in FIG. 4A. The nozzles 30 may be arranged in a staggered or zigzag manner such that one array of the nozzles 30 may be shifted by a half of the nozzle pitch from the other array of the nozzles 30. The nozzle plate 20 may be bonded to a surface of the channeled member 21, for example to the lower surface.

In example embodiments, the channeled member 21 may be constructed from a metallic material or silicon. The upper surface of the channeled member 21 may include an ink supply opening 31 that is connected to the ink cartridge 17 (refer to, for example, FIG. 1). In such embodiments, the channeled member 21 includes two manifolds 32 formed in an interior thereof, so as to extend along the sheet feeding direction. The two manifolds 32 may be connected to the one ink supply opening 31 such that ink supplied from the ink cartridge 17 is supplied to each of two manifolds 32.

In the embodiment shown, the channeled member 21 includes pressure chambers 33 formed on the upper surface thereof (e.g., a side opposite to a side to which the nozzle plate 20 is bonded). The pressure chambers 33 are configured to fluidly communicate with the corresponding nozzles 30. As seen in the example of FIG. 4A, the pressure chambers 33 may be disposed in two arrays, in correspondence with the nozzles 30, along the sheet feeding direction, for example in a zigzag or staggered manner. The pressure chambers 33 are covered with a vibration plate 40 of the piezoelectric actuator 22 from above. Each pressure chamber 33 may have a generally elliptical plane shape that is elongated along the scanning direction. Alternative chamber shapes, such as rectangular pressure chamber shapes, may be used as well. In the embodiment shown, an end of the pressure chamber 33 in its longitudinal direction, e.g., the scanning direction, fluidly communicates with the corresponding nozzle 30. As depicted in the example embodiment shown in FIGS. 3 and 4, the nozzles 30 in the left nozzle array in FIGS. 3 and 4 fluidly communicate with the left ends of the corresponding pressure chambers 33. The nozzles 30 in the right nozzle array in FIGS. 3 and 4 fluidly communicate with the right ends of the corresponding pressure chambers 33. In the embodiment shown, each nozzle 30 overlaps with an outward end of the corresponding pressure chamber 33 in the plan view. In other words, the nozzles 30 in the left and right nozzle arrays in FIGS. 3 and 4 overlap with the left and right ends of the corresponding pressure chambers 33, respectively. However, in alternative embodiments, the nozzles 30 may not overlap with the pressure chambers 33, but rather are offset from the pressure chambers 33 in a third direction (e.g., along the scanning direction as show n in FIG. 4A).

As depicted in FIGS. 3 and 4, a recess portion 35 may be disposed on the upper surface of the channeled member 21 at an area between the arrays of the pressure chambers 33. In the example shown, the recess portion 35 extends along a direction in which the nozzles 30 and the pressure chambers 33 are arranged (e.g., along the sheet feeding direction). A portion of each side inner wall surface of the recess portion 35 in its width direction includes a terminal placement surface 49 that is non-parallel with a plate surface of a plate provided on a channel unit and includes at least a portion of the terminal placement surface that is offset from the plate surface. In the example shown in FIGS. 3 and 4, the terminal placement surface 49 is illustrated as an inclined surface that is inclined with respect to the surface 40*a* of the vibration plate 40 (e.g., the scanning direction perpendicular to a direction in which the recess portion 35 extends). The terminals 46, 48 of the piezoelectric actuator 22 may be disposed on the inclined surface, e.g., a terminal placement surface 49. The recess portion 35 may be divided into two cavities 36 by a wall portion 53 of the cover member 23.

As depicted in FIGS. 2-4, each of two arrays of the pressure chambers 33 may be disposed to overlap the respective manifolds 32. The pressure chambers 33 may fluidly communicate with the manifolds 32 that may be disposed thereunder. As depicted in FIG. 4A, the channeled member 21 may comprise individual ink channels 34 branched from the manifolds 32 and configured to fluidly communicate with the corresponding nozzles 30 via the pressure chambers 33. In the example embodiment, the nozzle plate 20 and the channeled member 21 may correspond to a channel unit.

In the embodiment shown, the piezoelectric actuator 22 is disposed on the upper surface of the channeled member 21. As depicted in FIGS. 2-4, the piezoelectric actuator 22 includes the vibration plate 40, a piezoelectric layer 41, individual electrodes 42, and a common electrode 43.

Each of the two vibration plates 40 (e.g., one per array of pressure chambers) may be disposed on the upper surface of the channeled member 21 to cover the respective array of the pressure chambers 33. The vibration plate 40 may include, for example, metallic material or ceramic material. In another embodiment, when the channeled member 21 is formed of silicon, a silicon dioxide film may be formed on the surface of the channeled member 21. The silicon dioxide film may serve as the vibration plate 40. The vibration plate 40 may comprise a surface 40*a* that extends in the scanning direction. The surface 40*a* may have a common electrode 43 and the wirings 45, 47 formed thereon. Accordingly, when the vibration plate 40 is formed of conductive material, e.g., metal, an insulator film may be formed on the surface 40*a* of the vibration plate 40.

The piezoelectric layer 41 is disposed on the surface 40*a* of each vibration plate 40. In some embodiments, the piezoelectric layer 41 has a rectangular plane shape. The piezoelectric layer 41 includes a piezoelectric material whose main components may be, for example, ferroelectric lead zirconate titanate (PZT), which may include a solid solution of lead titanate and lead zirconate. The piezoelectric layer 41 may be directly formed on the surface 40*a* of the vibration plate 40 using a known film or layer formation technique, such as the spattering method or sol-gel method. In another embodiment, the piezoelectric layer 41 may be bonded to the vibration plate 40, after an unbaked thin sheet of the piezoelectric material is baked. As depicted in the example shown in FIGS. 2 and 3, the piezoelectric layer 41 is disposed to cover each array of the pressure chambers 33 such that the longitudinal direction of the piezoelectric layer 41 is parallel to the nozzle arrangement direction.

In the embodiment shown, the individual electrodes 42 are disposed at areas of the upper surface of the piezoelectric layer 41 opposing the respective pressure chambers 33. Accordingly, the individual electrodes 42 may be arranged in two arrays, along the nozzle arrangement direction, similar to the pressure chambers 33. Each individual electrode 42 may have an elliptical plane shape slightly smaller than the shape of the pressure chamber 33. The individual electrodes 42 may be positioned to oppose the central portions of the corresponding pressure chambers 33.

In the embodiment shown, wirings 45 for the individual electrodes 42 are disposed on the surface 40*a* of the vibration plate 40. The wiring 45 may be connected to an end of the respective individual electrode 42 opposite to the nozzle 30 in plan view The wiring 45 may extend from the respective individual electrode 42 in a longitudinal direction of the pressure chamber 33 (e.g., the right-left direction in FIG. 3) along the surface 40*a* of the vibration plate 40. More specifically, as depicted in FIG. 3, the wirings 45 may extend rightward and leftward from the respective individual electrodes 42 of the left and right arrays in FIG. 3, respectively. The recess portion 35 (e.g., the two cavities 36) may be disposed between the two piezoelectric layers 41 of the channeled member 21 in line with the piezoelectric layers 41 in the scanning direction. As shown, the wirings 45 inwardly extend from the respective individual electrodes 42 of each array to the recess portion 35 (e.g., the two cavities 36) disposed on the inner side of the respective array of the individual electrodes 42.

A terminal 46 for the individual electrode 42 may be disposed at an end of each wiring 45 (e.g., an end opposite to the individual electrodes 42). In the example shown, the terminals 46 are arranged in two arrays along the scanning direction in correspondence with the respective arrays of the individual electrodes 42 between the arrays of the individual electrodes 42. More specifically, the array of the terminals 46 corresponding to the left array of the individual electrodes 42 in FIG. 3 may be disposed along the nozzle arrangement direction at an inclined surface formed at the inner wall surface of the left cavity 36. The array of the terminals 46 corresponding to the right array of the individual electrodes 42 in FIG. 3 may be disposed along the nozzle arrangement direction at an inclined surface formed at the inner wall surface of the right cavity 36. The inclined surfaces of the cavities 36 where the terminals 46 for the individual electrodes 42 may be disposed may be hereinafter referred to as "the terminal placement surface 49". The COF 24 may be connected to the respective array of the terminals 46 disposed on the respective terminal placement surface 49. Thus, the individual electrodes 42 may be connected to the driver ICs 50 mounted on the COFs 24.

As depicted in FIG. 4A, the common electrode 43 is disposed between the piezoelectric layer 41 and the vibration plate 40. The common electrode 43 may extend across the pressure chambers 33 along the nozzle arrangement direction, as depicted in FIG. 3. In the embodiment shown, the common electrode 43 contacts almost the entire lower surface of the corresponding piezoelectric layer 41. As depicted in FIG. 3, wirings 47 for the common electrode 43 are disposed on the surface 40*a* of the vibration plate 40 along the scanning direction. In such an arrangement, the two wirings 47 may be connected to one common electrode 43. The two wirings 47 connected to the left common electrode 43 in FIG. 3 may extend to the left cavity 36. A terminal 48 for the common electrode 43 may be disposed at an end of each wiring 47. The terminals 48 may be disposed on the terminal placement surface 49 of the inner wall surface of the left cavity 36. Similarly, the two wirings 47 connected to the right common electrode 43 in FIG. 3 may extend to the right cavity 36. The terminals 48 disposed at ends of the wirings 47 may be disposed on the inclined terminal placement surface 49 of the right cavity 36. The COFs 24 may be connected to the terminals 48. Thus, the common electrodes 43 may be connected to the driver ICs 50 mounted on the COFs 24 and constantly maintained in ground potential by the driver ICs 50.

Each of the terminals 46 for the individual electrodes 42 and the terminals 48 for the common electrodes 43 may have a circular shape in plan view. The terminal placement surface 49 may be inclined with respect to the vibration plate 40. Therefore, in FIG. 3 which is viewed from a direction perpendicular to the vibration plate 40, the terminals 46, 48 may be depicted in an elliptical shape in which distances, e.g., widths, of the terminals 46, 48 in the scanning direction may be smaller. The terminals 46 and the terminals 48 may correspond to example embodiments of contact terminals.

As depicted in FIG. 4A, a piezoelectric element 44 may be disposed at a portion of the piezoelectric layer 41 opposing one of the pressure chambers 33 between one of the individual electrodes 42 and the common electrode 43. In this example embodiment, the piezoelectric element 44 corresponds to an example implementation of a drive element. For example, the piezoelectric element 44 may deform when a drive signal is supplied to the individual electrode 42 from the driver IC 50, and may apply ejection energy to ink in the pressure chamber 33. Each piezoelectric element 44 may be polarized in its thickness direction. The piezoelectric elements 44 may be arrayed along the nozzle arrangement direction in correspondence with each of the two arrays of the pressure chamber 33. The two arrays of the piezoelectric elements 44 may be arranged in the scanning direction. In FIG. 3, one piezoelectric layer 41 may be disposed across the pressure chambers 33 that may be arranged in array. One piezoelectric layer 41 may be provided for a plurality of the individual electrode 42. In another embodiment, one piezoelectric layer 41 may be provided in correspondence with a single individual electrode 42. In the example embodiment, the individual electrodes 42 may be disposed on the upper surface of the piezoelectric layer 41 and the common electrodes 43 may be disposed on the lower surface of the piezoelectric layer 41. In another embodiment, the individual electrodes 42 may be disposed on the lower surface of the piezoelectric layer 41 and the common electrodes 43 may be disposed on the upper surface of the piezoelectric layer 41.

In the example embodiment shown, the cover member 23 is bonded to the channeled member 21 and the vibration plates 40 while covering the two piezoelectric layers 41. The cover member 23 may be provided to reduce the entry of external moisture into the piezoelectric elements 44 by blocking the piezoelectric layers 41 from the atmosphere. As depicted in FIGS. 2-4, the cover member 23 may comprise two seal portions 51, a connecting portion 52 and the wall portion 53.

In example configurations, each seal portion 51 may have a rectangular box shape. The seal portion 51 may be disposed at the surface 40*a* of the vibration plate 40 such that the seal portion 51 is upside down with the bottom of the seal portion 51 being placed in an upper side. The seal portion 51 may entirely cover the corresponding piezoelectric layer 41 of a rectangular shape from above. The connecting portion 52 may be disposed between the two seal portions 51 and connect the two seal portions 51. The connecting portion 52 may have two through holes 52*a* of a rectangular shape elongated in the nozzle arrangement direction. A portion of the connecting portion 52 between the two through holes 52*a* may be provided with the wall portion 53 extending downward along the longitudinal direction of the through holes 52*a*. The entire length of the wall portion 53 may contact with the bottom surface of the recess portion 35 of the channeled member 21 to separate or divide the two arrays of the piezoelectric elements 44. The wall portion 53 may divide the recess portion 35 into the two cavities 36. Upper two corners of the wall portion 53 may be chamfered to form inclined surfaces 53*a*.

In example embodiments, each of the two COFs 24 inserted into the corresponding through hole 52*a* of the cover member 23 may be bonded to the terminal placement surface 49 of the corresponding cavity 36. The driver IC 50 may be mounted on a portion of each COF 24 extending outside the cover member 23. The driver IC 50 may be placed on the upper surface of each seal portion 51 of the cover member 23. Wirings (not depicted) formed on each COF 24 may electrically connect the driver IC 50 with the terminals 46 for the individual electrodes 42 and the terminals 48 for the common electrode 43 that are provided on the terminal placement surface 49.

Various circuits configured to drive the piezoelectric elements 44 may be integrated in the driver IC 50. The COFs 24 may be connected to a control board (not depicted). Various control signals may be transmitted from the control board to the driver IC 50 mounted on each of the two COFs 24. The driver IC 50 may be configured to output drive signals generated based on the control signals input from the control board, to the individual electrodes 42, so that the piezoelectric elements 44 may be individually driven. The driver IC 50 may keep the potential of the common electrode 43 at the ground potential.

In the example embodiment, the flexible wiring board, e.g., the COF 24 on which the driver IC 50 may be mounted, is connected to the terminals 46, 48 provided on the terminal placement surface 49. In another embodiment, the flexible wiring board on which the driver IC 50 might not be mounted, is connected to the terminals 46, 48.

In use, a drive signal may be input from the driver IC 50 to an individual electrode 42. This drive signal may cause the vibration plate 40 covering the corresponding pressure chamber 33 to deforms to project toward the pressure chamber 33, to change the volumetric capacity of the pressure chamber 33. Accordingly, pressure (e.g., ejection energy) is applied to ink in the pressure chamber 33 to eject an ink droplet from the corresponding nozzle 30 fluidly communicating with the pressure chamber 33.

In example embodiments, each COF 24 is bonded to the terminals 46, 48 on the terminal placement surface 49, for example using a conductive bonding material having fluidity, e.g., solder or conductive adhesive. For example, the COF 24 may be bonded to the terminals 46, 48 using anisotropic conductive adhesive. The anisotropic conductive adhesive, e.g., an anisotropic conductive film (ACF) or anisotropic conductive paste (ACP), may comprise thermosetting resin in which conductive particles may be dispersed. The anisotropic conductive adhesive may be applied to the terminal placement surface 49 such that the terminals 46, 48 may be covered. Then, the COF 24 may be pressed against the terminal placement surface 49 while the COF 24 is heated. Great pressure may be locally applied to a portion of anisotropic conductive adhesive that may exist between the terminals 46, 48 disposed on the terminal placement surface 49 and terminals of the COF 24, so that the terminals of the COF 24 and the terminals 46, 48 may be electrically connected by the conductive particles. At the same time, the anisotropic conductive adhesive that may be pushed outward when the pressure is applied thereto may be hardened by the application of heat and the COF 24 and the terminal placement surface 49 may be mechanically bonded.

Figure 4B:
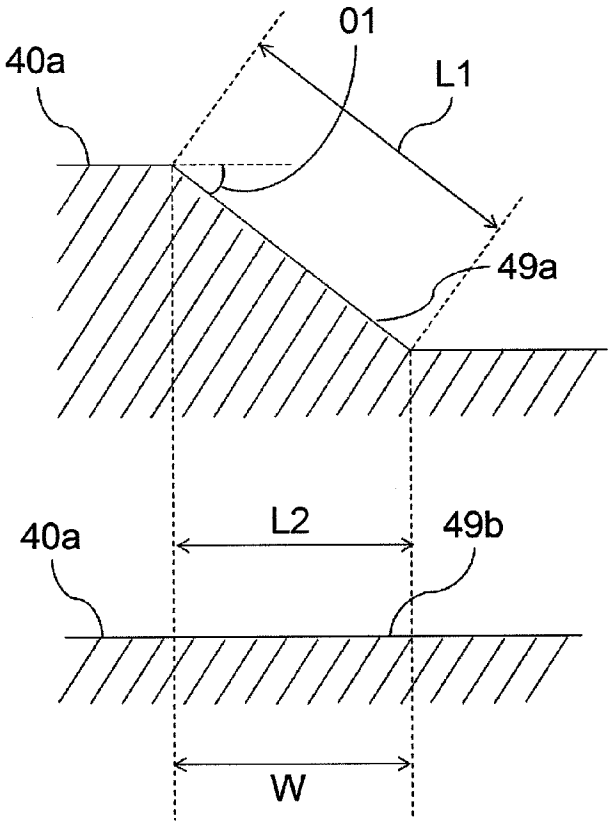
FIG. 4B is a partially enlarged cross-sectional view of the inkjet head of FIG. 2 showing an inclined surface and a flat surface.

As depicted in the example configuration shown in FIG. 4A, an inner wall surface of the cavity 36, e.g., the terminal placement surface 49, where the terminals 46 for the individual electrodes 42 and the terminals 48 for the common electrode 43 are disposed, is inclined with respect to the surface 40*a* of the vibration plate 40. Referring to FIG. 4B, the terminal placement surface 49*a* inclined with respect to the surface 40*a* and a terminal placement surface 49*b* parallel to the surface 40*a* may be compared. As depicted in FIG. 4B, the terminal placement surface 49*a* is inclined 01 degrees with respect to the surface 40*a*. The terminal placement surface 49*a* may have a length L1 and a width W. The length L1 may be equal to W/cos θ1. The length L1 may be greater than the width W (L1>W) because cos θ1<0 (θ1≠0 degrees). A length L2 of the terminal placement surface 49*b* may be equal to the width W. Therefore, the length L1 may be greater than the length L2. When projected areas of the terminal placement surfaces 49*a* and 49*b* are the same when viewed from a direction perpendicular to the surface 40*a*, a greater surface area may be provided for the terminal placement surface 49*a* than the terminal placement surface 49*b*. Therefore, the width W of the terminal placement surface 49 may be reduced while a certain area is maintained for each terminal 46, 48. Thus, the size of the inkjet head 4 may be reduced in the same dimension as width W. Especially, when the channeled member 21 is formed by etching silicon, increase in the size of the channeled member 21 may be directly linked to increase in costs. Therefore, reduction of costs by reducing the width W of the terminal placement surface 49 may be effective.

In the example embodiment, the terminal placement surface 49 includes an inclined surface on an inner wall surface of the cavity 36 disposed between the channeled member 21 and the cover member 23. With such a structure, when the COF 24 and the terminals 46, 48 provided on the terminal placement surface 49 are bonded, an excess of the conductive bonding material having fluidity, e.g., conductive adhesive or solder, may flow down onto the bottom surface of the cavity 36. Therefore, such a problem, e.g., a short-circuit, that may be caused by a buildup of the excessive conductive bonding material at the peripheries of the terminals 46, 48 may be reduced.

To bond the COF 24 onto the terminal placement surface 49, the COF 24 may be pressed against the terminal placement surface 49 while the COF 24 is being heated using a, fixture, e.g., a jig 55, that may comprise a heater. In cases where the anisotropic conductive adhesive is used for bonding the COF 24 and the terminals 46, 48, insufficient force of pressing the COF 24 may cause the reduced reliability of electrical connection between the terminals of the COF 24 and the terminals 46, 48 because the conductive particles might not electrically interconnect the terminals of the COF 24 and the terminals 46, 48. Therefore, in some cases, the COF 24 may be pressed against the terminal placement surface 49 comprising an inclined surface in a normal direction of the terminal placement surface 49. In examples where the anisotropic conductive adhesive is used for bonding the COF 24, the COF 24 may need to be firmly pressed against terminal placement surface 49. As the COF 24 is pressed against the terminal placement surface 49 comprising an inclined or curved surface in its the normal direction, the COF 24 may be firmly pressed against terminal placement surface 49 with relatively strong pressing pressure.

Figure 5:
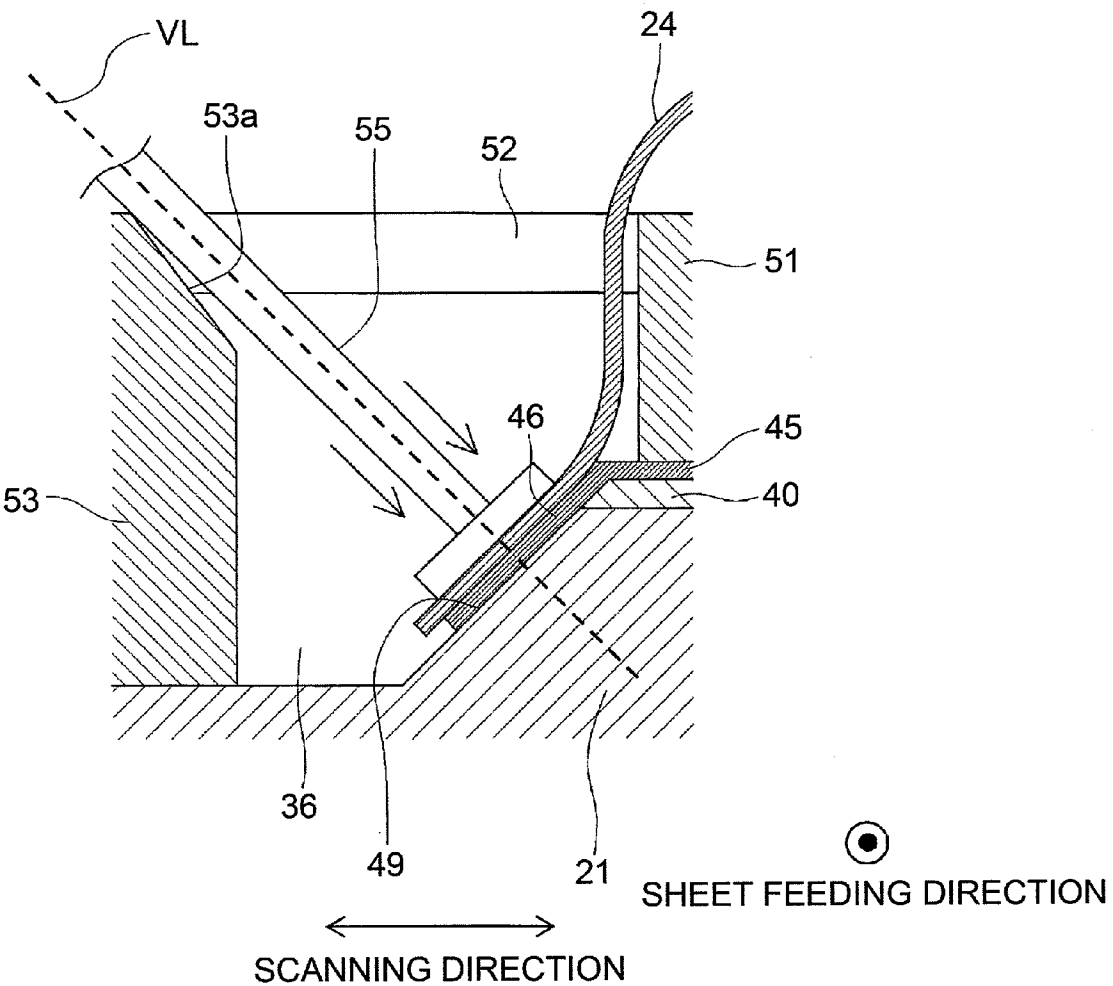
FIG. 5 is a partially enlarged cross-sectional view of the inkjet head showing a bonding process of the COF.

In examples where the terminal placement surface 49 is provided on an inner wall surface of the cavity 36, the COF 24 may sometimes be difficult to press against the terminal placement surface 49 in the normal direction thereof. In the example embodiment, the corners of the upper ends of the wall portion 53 of the cover member 23 defining the cavities 36 may be chamfered to form the inclined surface 53*a*, as depicted in FIG. 4A. As depicted in FIG. 5, the inclined surface 53*a* may be disposed at a portion of the open end of the cavity 36, e.g., at an edge of an opening of the cavity 36, on a side opposite to the terminal placement surface 49. In such examples, the inclined surface 53*a* does not interfere with a virtual line VL extending along the normal direction of the terminal placement surface 49. In other words, there exists at least one such virtual line normal to the terminal displacement surface 49 that does not intersect the inclined surface 53*a*. The jig 55 used for pressing the COF 24 may be slantingly inserted into the cavity 36 along the inclined surface 53*a*. Thus, the COF 24 may be pressed in the normal direction of the terminal placement surface 49 against the terminal placement surface 49 comprising an inclined surface, which may be disposed at an inner wall surface of the cavity 36. Accordingly, the COF 24 may be reliably bonded to the terminals 46, 48 on the terminal placement surface 49. The inclined surface 53*a* provided on the wall portion 53 may correspond to a border portion. The inclined surface 53*a* may extend in the sheet feeding direction. The shape of the border portion might not be limited to the shape of the inclined surface 53*a* as depicted in FIG. 5. For example, a groove corresponding to each terminal 46, 48 may be provided at the edge of the opening of the cavity 36 along the sheet feeding direction.

While the disclosure has been described in detail with reference to the specific embodiment thereof, this is merely an example, and various changes, arrangements and modifications may be applied therein without departing from the spirit and scope of the disclosure.

Example modifications in which alternative designs are described relative to the above-described example embodiment. Like reference numerals may be used for like corresponding components in FIGS. 6A-18B and a detailed description thereof with respect to FIGS. 6A-18B may be omitted herein.

First Example Modification

Figure 6A:
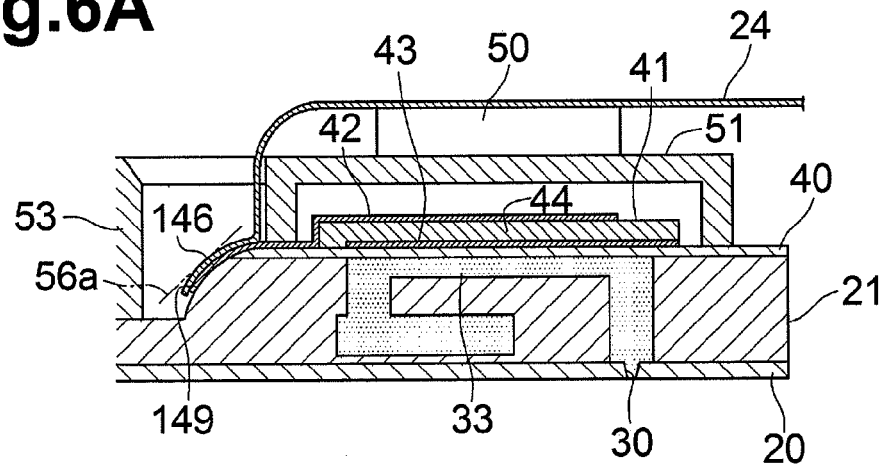
FIGS. 6A and 6B are cross-sectional views of an inkjet head according to a first example modification.
Figure 6B:
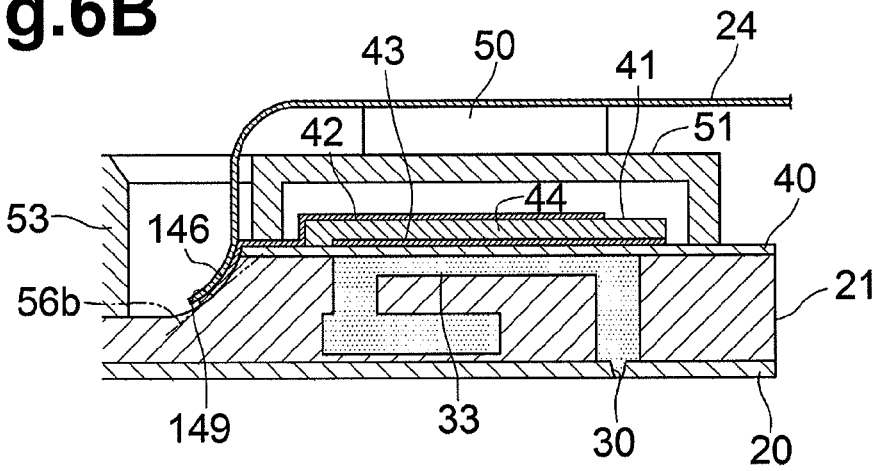

In a first example modification, the terminal placement surface 49 on which the terminals 46, 48 are provided may be curved. For example, the terminal placement surface 49 may be convexly curved as depicted in FIG. 6A, or concavely curved as depicted in FIG. 6B.

Figure 7:
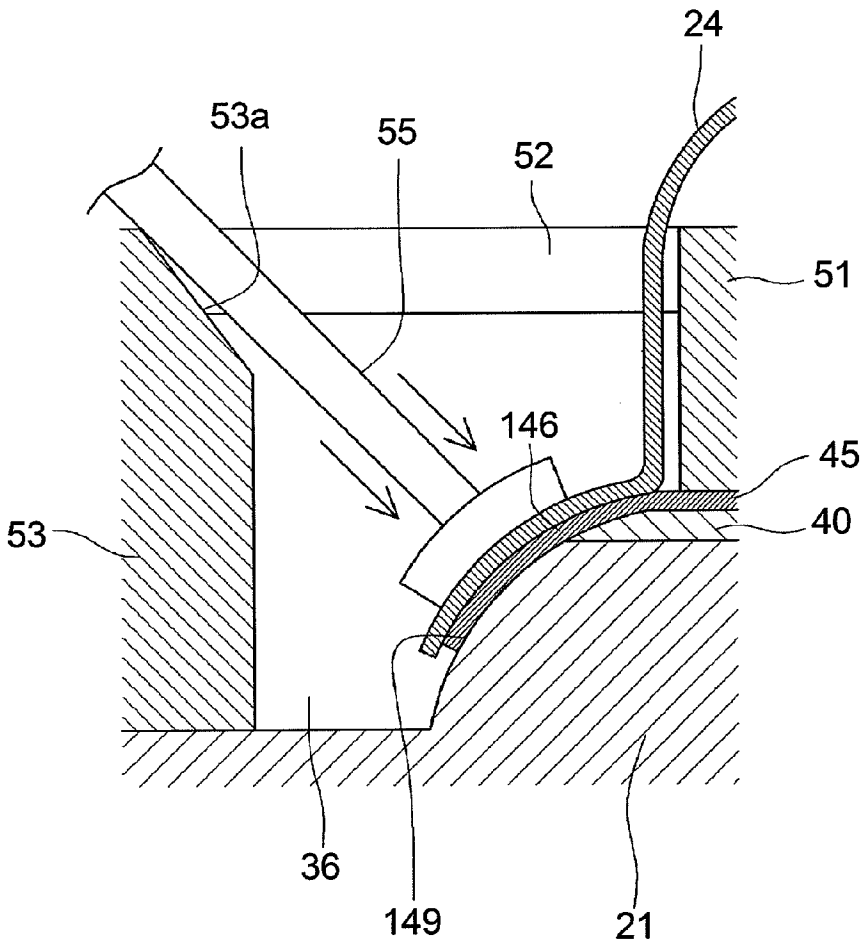
FIG. 7 is a partially enlarged cross-sectional view of the inkjet head of FIG. 6A showing a bonding process of the COF.

If a terminal placement surface 149 is curved, the COF 24 may be pressed against the terminal placement surface 149 with the jig 55 that may have a curve shape corresponding to the terminal placement surface 149, as depicted in FIG. 7. In this case also, it may be preferable that the COF 24 may be pressed against the terminal placement surface 149 in the normal direction of the terminal placement surface 149. The normal direction of the terminal placement surface 149 that may be convexly curved as depicted in FIG. 6A, may be a direction perpendicular to a tangent plane 56*a* at the top of the curved surface. The normal direction of the terminal placement surface 149 that may be concavely curved as depicted in FIG. 6B, may be a direction perpendicular to a tangent plane 56*b* at the bottom of the curved surface.

When the terminal placement surface 149 is curved, an area of the terminal placement surface 149 may further be increased as compared with the inclined surface in the above-described example embodiment. In the above-described example embodiment, the terminal placement surface 149 may be inclined with respect to the vibration plate 40, but the terminal placement surface 149 itself may be flat. When the terminal placement surface 149 itself is curved as in the example modification, it may be difficult to press the COF 24 against the terminal placement surface 149 with uniform force, leading to a difficult bonding operation. As compared with the convexly curved terminal placement surface 149 in FIG. 6A and the inclined terminal placement surface 149 in FIG. 4A, the concavely curved terminal placement surface 149 in FIG. 6B may be more readily formed by etching the base material. Therefore, a concavely curved surface may be more readily formed than the inclined surface or the convexly curved surface.

When the normal direction of the curved terminal placement surface 149 is parallel to the surface 40*a* of the vibration plate 40 (e.g., the tangent plane of the curved surface is perpendicular to the vibration plate 40), it may be difficult to bond the COF 24 to the terminal placement surface 149 from above (e.g., a direction perpendicular to the vibration plate 40). Therefore, it may be preferable that the normal direction of the terminal placement surface 149 might not be parallel to the surface 40*a* of the vibration plate 40.

To simplify the description of the disclosure, the following example modifications are described in connection with one of the inclined and curved terminal placement surfaces. Even so, the disclosure may be applied to the other one of the inclined and curved terminal placement surface, unless otherwise specified.

The terminal placement surface 149 may comprise not only the inclined surface or the curved surface, but also may comprise a surface parallel to the surface 40*a* of the vibration plate 40 in addition to the inclined surface or the curved surface.

Second Example Modification

Figure 8A:
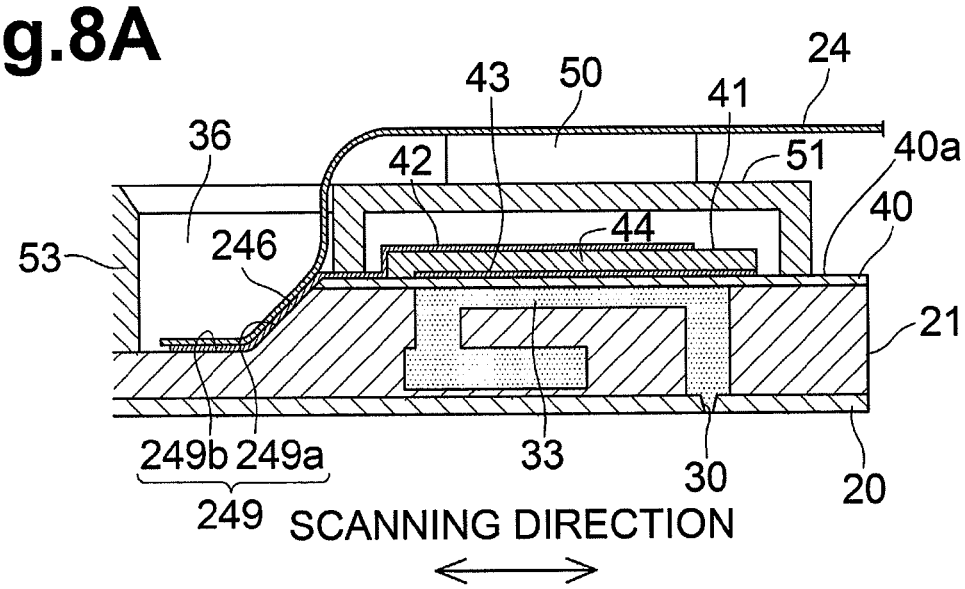
FIGS. 8A and 8B are cross-sectional views of an inkjet head according to a second example modification.
Figure 8B:
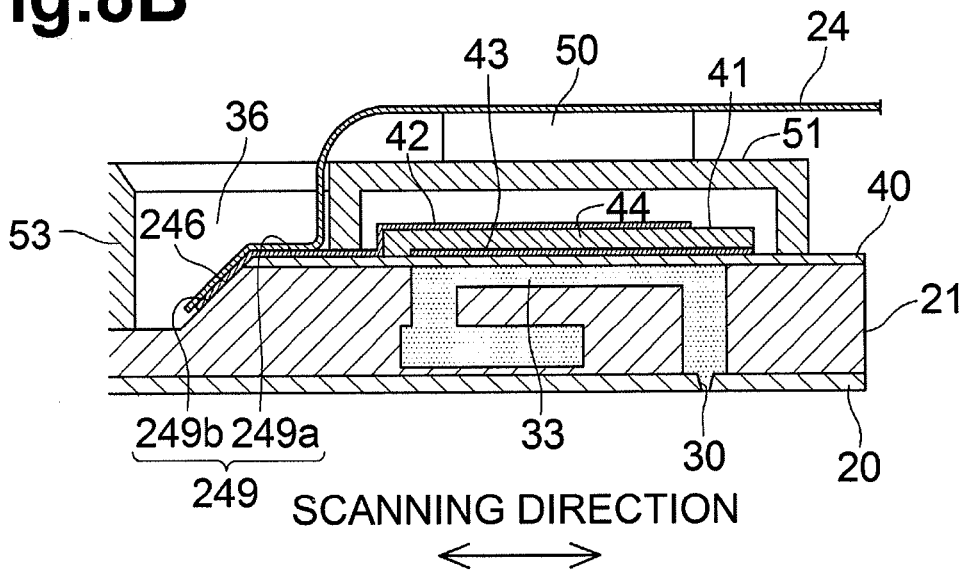

As depicted in the example modification shown in FIGS. 8A and 8B, a terminal placement surface 249 includes a first terminal placement surface 249*a* and a second terminal placement surface 249*b*. Each of the first terminal placement surface 249*a* and the second terminal placement surface 249*b* may extend in the sheet feeding direction. The first terminal placement surface 249*a* may be inclined with respect to the scanning direction. The second terminal placement surface 249*b* may be parallel to the surface 40*a* of the vibration plate 40. An end of the first terminal placement surface 249*a* in the scanning direction may be connected to the second terminal placement surface 249*b*. In another embodiment, the first terminal placement surface 49*a* may be curved.

In the example of FIG. 8A, the second terminal placement surface 249*b* is connected to the lower end of the first terminal placement surface 249*a*, which may be the inclined surface. The second terminal placement surface 249*b* may be disposed at a flat bottom surface of the cavity 36. In the example of FIG. 8B, the second terminal placement surface 249*b* may be connected to the upper end of the first terminal placement surface 249*a*, and the second terminal placement surface 249*b* may be disposed at the surface 40*a* of the vibration plate 40.

In this example, the terminal placement surface 249 includes the second terminal placement surface 249*b* parallel to the surface 240*a* of the vibration plate 40, in addition to the first terminal placement surface 249*a*, which may be the inclined surface or the curved surface. Therefore, when external force is applied to the COF 24 in a direction in which the COF 24 is separate from the terminal placement surface 249, directions in which the COF 24 is likely to be separate or removed from the first terminal placement surface 249*a* and the second terminal placement surface 249*b* may be different from each other. Accordingly, the COF 24 disposed on the inclined or curved first terminal placement surface 249*a* and the second terminal placement surface 249*b* parallel to the surface 40*a* may be more difficult to be removed when external force is applied to the COF 24 in a direction in which the COF 24 is separate from the terminal placement surface 249, as compared with a case in which the first terminal placement surface 249*a* and the second terminal placement surface 249*b* are provided on the same plane and directions in which the COF 24 is likely to be removed from the first terminal placement surface 249*a* and the second terminal placement surface 249*b* are the same.

In the example shown in FIGS. 8A and 8B, one terminal 246 for the individual electrode 42 is provided over the first terminal placement surface 249*a* and the second terminal placement surface 249*b*. When the first terminal placement surface 249*a* comprising the inclined surface or the curved surface might not ensure the sufficient area for the terminal 246, the second terminal placement surface 249*b* parallel to the vibration plate 40 may be provided.

Third Example Modification

Figure 9A:
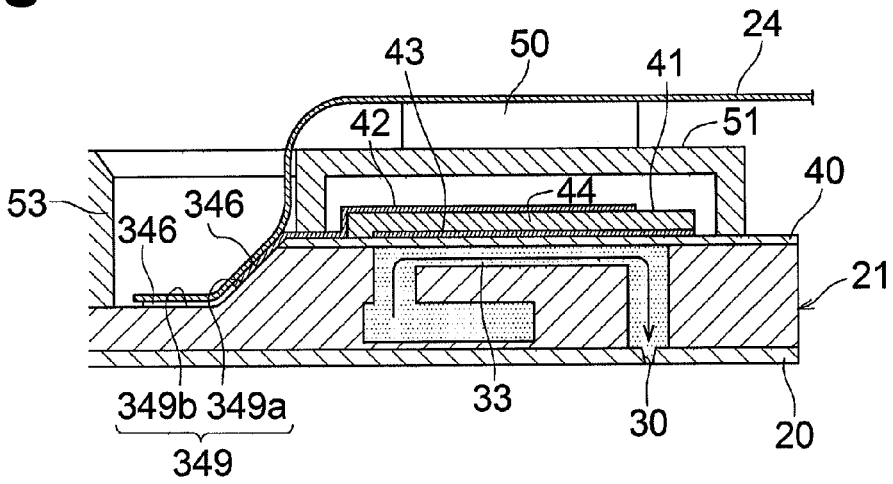
FIGS. 9A and 9B are cross-sectional views of an inkjet head according to a third example modification.
Figure 9B:
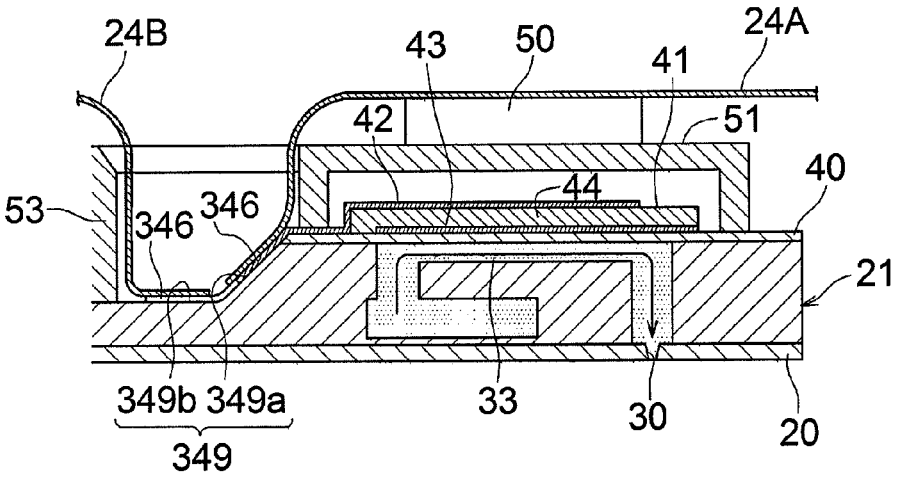
Figure 10:
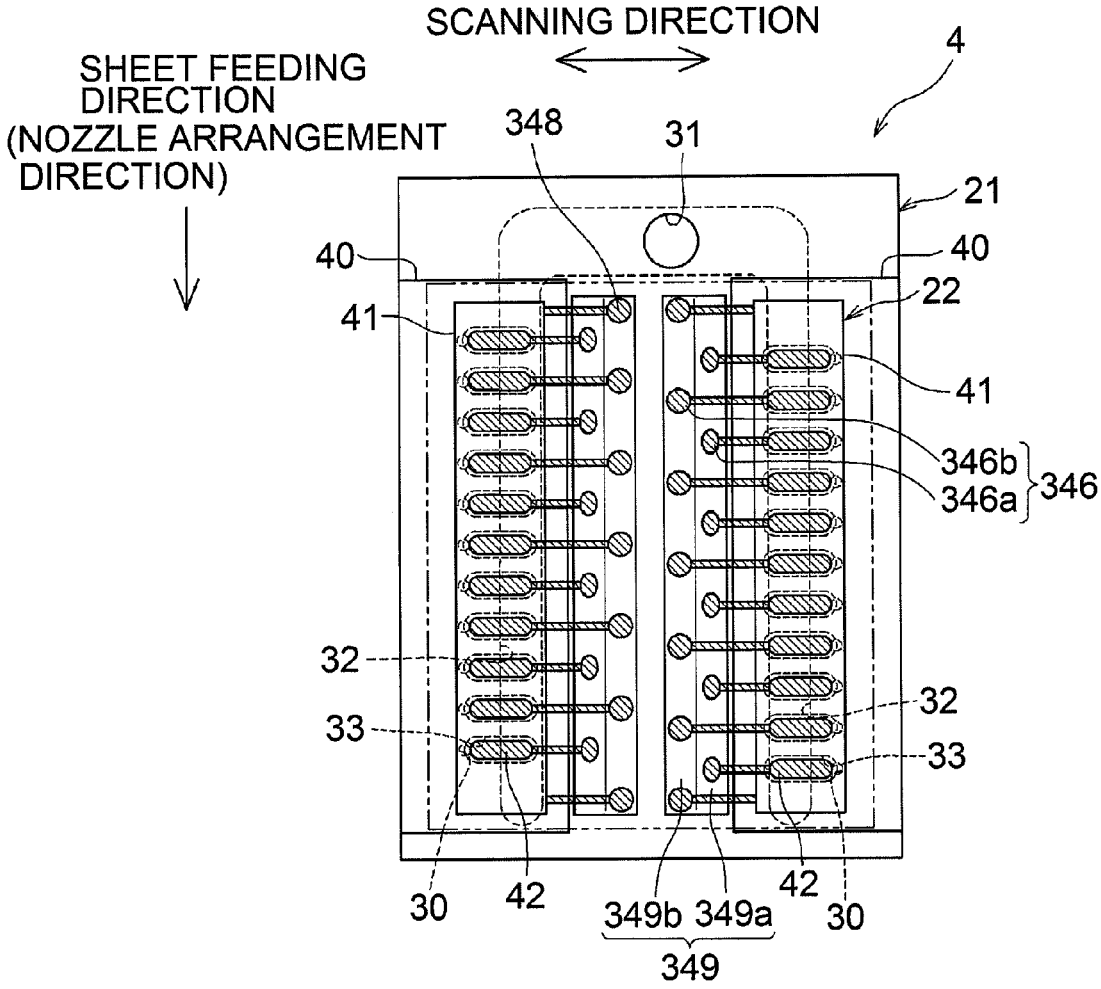
FIG. 10 is a plane view of the inkjet head according to the third example modification.

In a third example modification, a terminal placement surface 349 includes a first terminal placement surface 349*a* and a second terminal placement surface 349*b*. In this example, terminals 346 for the individual electrodes 42 may be provided separately for the first terminal placement surface 349*a* and the second terminal placement surface 349*b*, as depicted in FIGS. 9A-10. In the example of FIG. 10, an array of first terminals 346*a*, for the individual electrodes 42 disposed at the first terminal placement surface 349*a*, and an array of second terminals 346*b*, for the individual electrodes 42 disposed at the second terminal placement surface 349*b*, may be arranged along the nozzle arrangement direction in which the terminal placement surfaces 349*a*, 349*b* extend. In some such embodiments, the terminals 346 disposed at the first terminal placement surface 349*a* and the second terminal placement surface 349*b* might not align in the scanning direction. In an example of FIG. 10, the terminals 346 for the individual electrodes 42 may be densely disposed with a certain distance ensured between the adjacent first terminal 346*a* and second terminal 346*b* while risk of a short circuit or ion migration is at least reduced. The first terminals 346*a* for the individual electrodes 42 disposed at the first terminal placement surface 349*a*, and the second terminals 346*b* for the individual electrodes 42 disposed at the second terminal placement surface 349*b*, may be arranged in any manner without being limited to the zigzag or staggered manner.

When the terminals 346 for the individual electrodes 42 are disposed on the first terminal placement surface 349*a* and the second terminal placement surface 349*b*, one COF 24 may be bonded to both of the first terminal placement surface 349*a* and the second terminal placement surface 349*b*, as depicted in the example of FIG. 9A. In another embodiment, one COF 24 may be bonded to each of the first terminal placement surface 349*a* and the second terminal placement surface 349*b*, as depicted in FIG. 9B. More specifically, a first flexible wiring board 24A, may be bonded to the terminals 346 for the individual electrodes 42 disposed on the first terminal placement surface 349*a*. A second flexible wiring board 24B, may be bonded to the terminals 346 for the individual electrodes 42 disposed on the second terminal placement surface 349*b*.

When the terminals 346 for the individual electrodes 42 are densely arranged and corresponding terminals are arranged on one COF 24, the terminals of the COF 24 may be densely arranged, which may utilize special patterning and may lead to increase in costs. When the COFs 24A and 24B are employed to connect to the terminal placement surfaces 349*a*, 349*b*, respectively, as depicted in FIG. 9B, density of the terminals on the COFs 24A and 24B may be reduced. Therefore, a general-purpose COF as discussed herein may be used to reduce costs.

Fourth Example Modification

In a fourth example modification, different types of terminals may be disposed on a first terminal placement surface 449*a* and a second terminal placement surface 449*b*.

Figure 11:
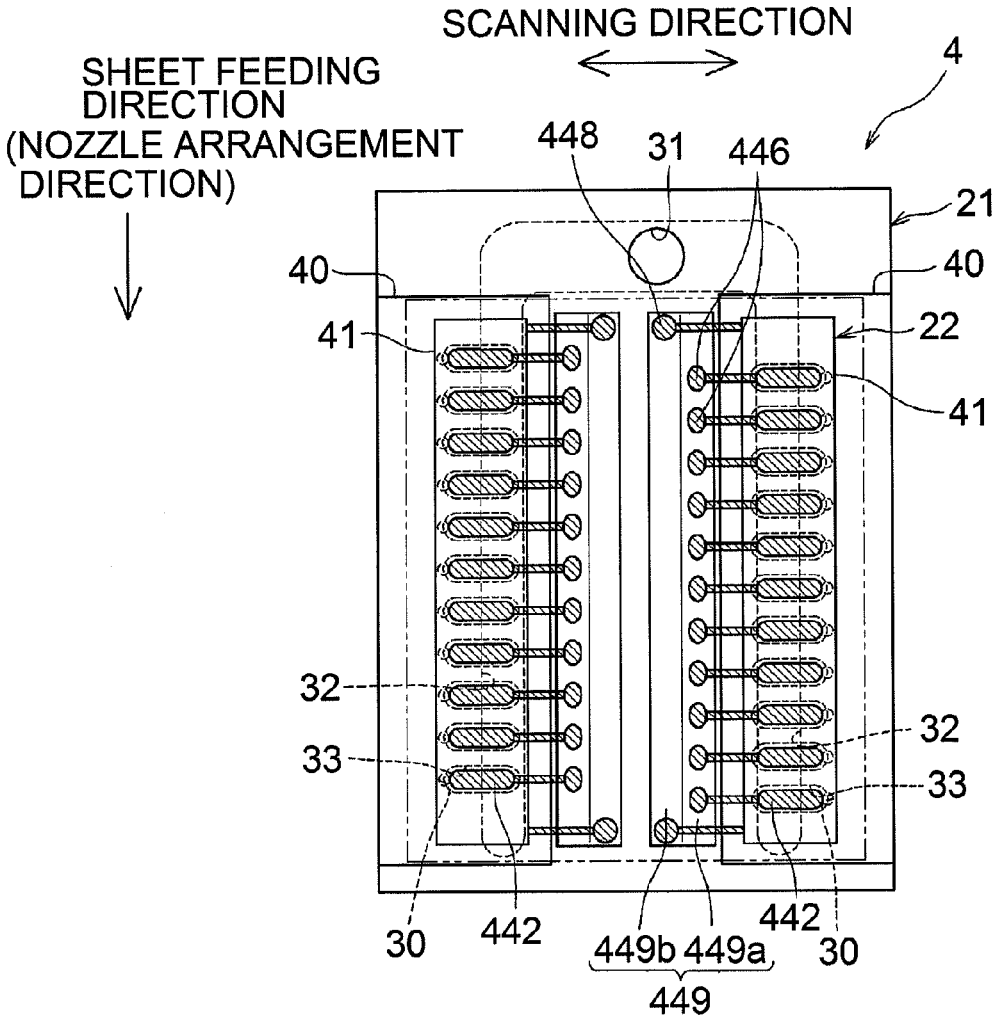
FIG. 11 is a plane view of an inkjet head according to a fourth example modification.

For example, as depicted in FIG. 11, first contact terminals 446, which may be connected to first electrodes 442, may be disposed on the first terminal placement surface 449*a*. Second contact terminals 448, which may be connected to the common electrode 43, may be disposed on the second terminal placement surface 449*b*.

It may be difficult to press the COF 24 from a direction normal to a plate surface of vibration plate 40 against the first terminal placement surface 449*a* comprising an inclined surface (or a curved surface), as compared with the second terminal placement surface 449*b*, which may be parallel to the vibration plate 40. Therefore, it is possible that the electrical resistance of a connecting portion between the COF 24 and the terminals on the first terminal placement surface 449*a* may increase. Potential of the common electrode 43 that may be common to the piezoelectric elements 44 may be kept at a reference potential (e.g., ground potential). If the electrical resistance in a portion of a conduction path connected to the common electrode 43 is increased, the potential of the common electrode 43 may readily fluctuate from the reference potential under the influence of a voltage drop. In this respect, the second contact terminals 448 for the common electrode 43 may be disposed on the second terminal placement surface 449*b* against which the COF 24 may be firmly pressed.

Fifth Example Modification

Figure 12:
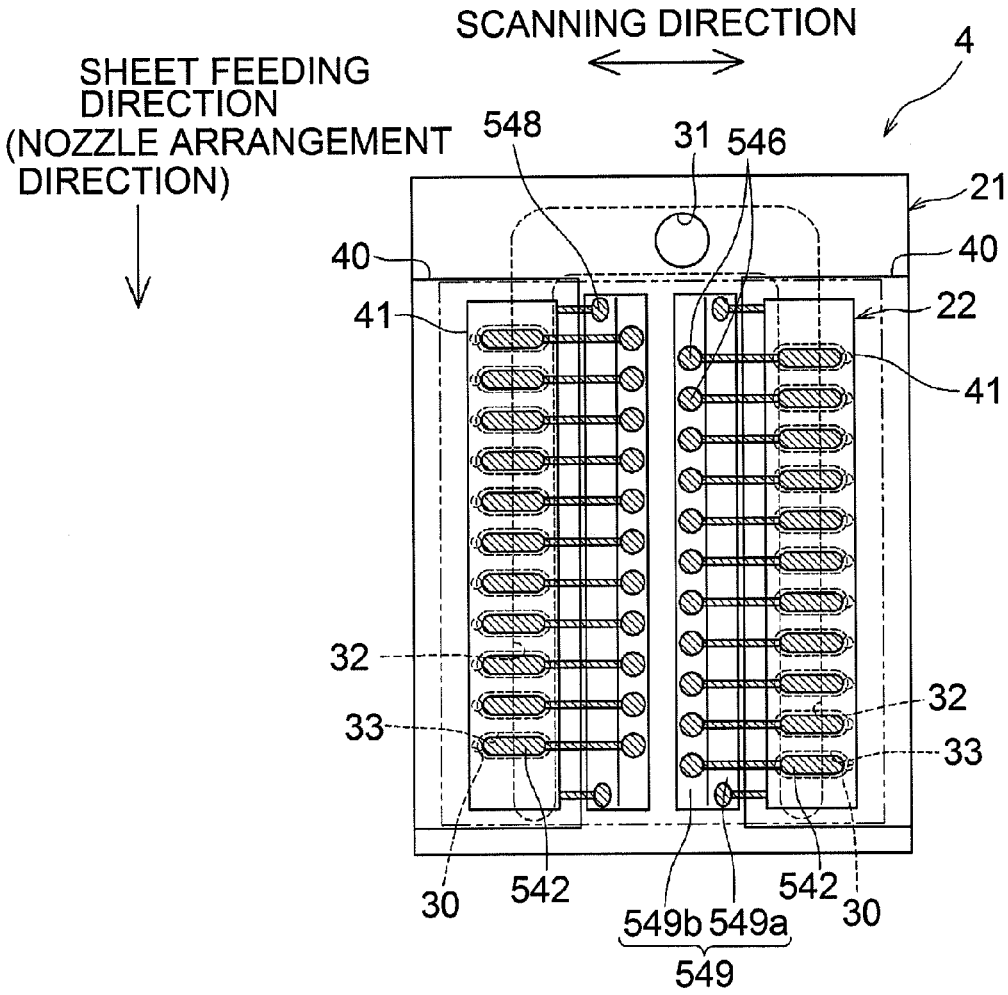
FIG. 12 is a plane view of an inkjet head according to a fifth example modification.

In a fifth example modification, a further illustrated variation is shown in which, terminals 546, 548 may be arranged at positions opposite to those of FIG. 11 (in the fourth example modification). In other words, as depicted in FIG. 12, a first contact terminals 548 for the common electrode 43, may be disposed on a first terminal placement surface 549*a* and a second contact terminals 546 for an individual electrodes 542, may be disposed on a second terminal placement surface 549*b*.

It may be difficult, in some cases, to press the COF 24 against the first terminal placement surface 549*a* including an inclined surface (or a curved surface), as compared with pressing a COF 24 against the second terminal placement surface 549*b*. This may mean that reliability of electrical connection between the terminals of the COF 24 and the terminals 48 disposed on the first terminal placement surface 549*a*, may be reduced or become lower as compared with the electrical connection between the terminals of the COF 24 and the terminals 46 disposed on the second terminal placement surface 549*b*. If the second contact terminal 546 for an individual electrode 542 and the COF 24 are electrically disconnected, the corresponding piezoelectric element 44 might not be driven. If the COF 24 and the common electrode 43 electrically connected via a plurality of the first contact terminals 548, such a critical problem that the piezoelectric element 44 might not be driven might not occur, even if one of the first contact terminals 548 is electrically disconnected from the COF 24. In this respect, it may be preferable that the second contact terminals 546 for the individual electrodes 542 may be disposed on the second terminal placement surface 549*b* against which the COF 24 may be firmly pressed.

Figure 13A:
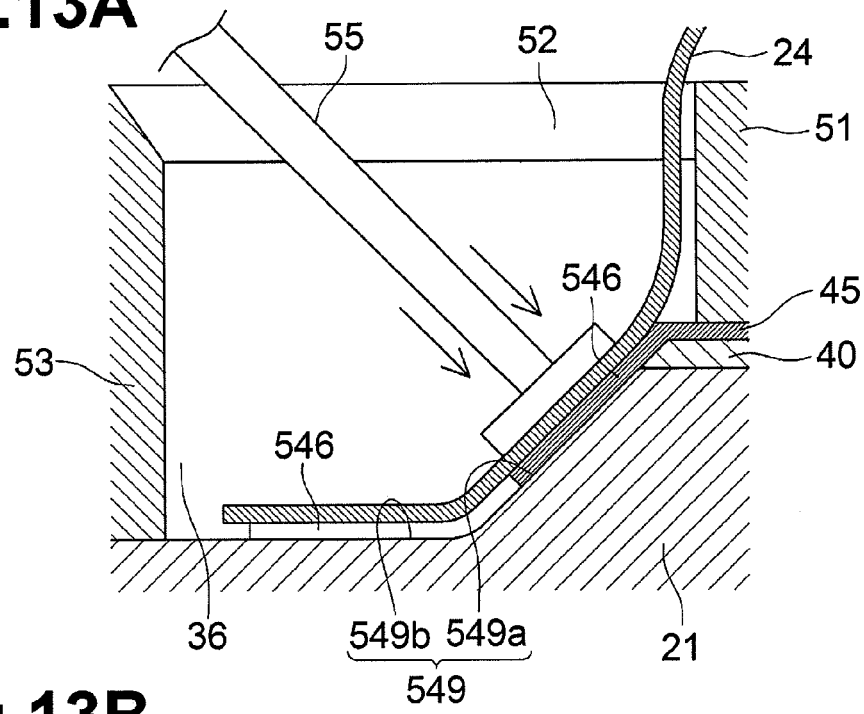
FIGS. 13A and 13B are cross-sectional views of the inkjet head according to the second to fifth example modifications, showing a bonding process of the COF.
Figure 13B:
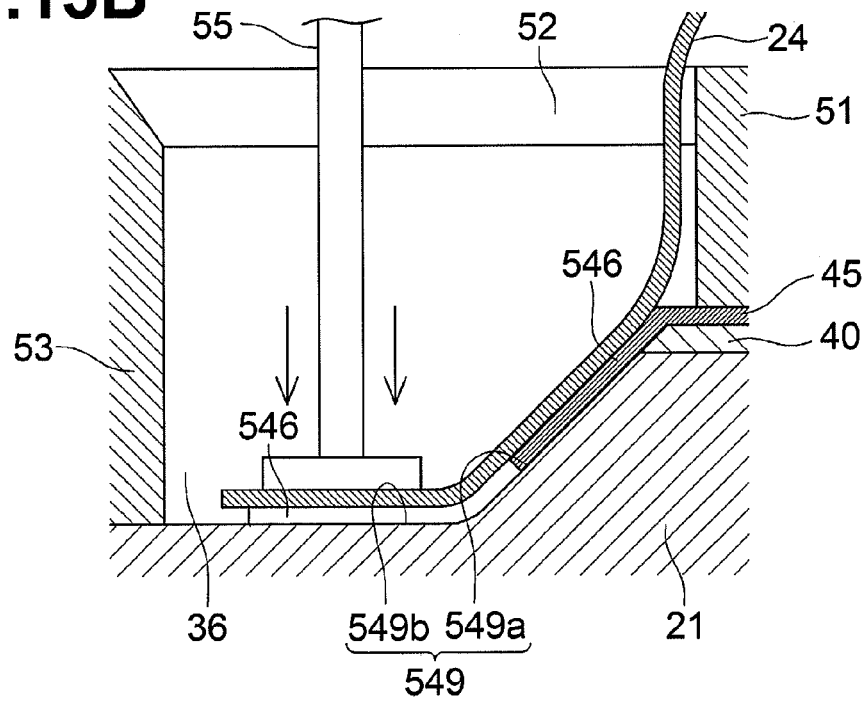

If the terminal placement surface 549 includes the first terminal placement surface 549*a* and the second terminal placement surface 549*b*, as in the second to fifth example modifications, it may be preferable that the COF 24 is pressed against the first terminal placement surface 549*a* and the second terminal placement surface 549*b* in their respective normal directions. For example, for the first terminal placement surface 549*a* comprising an inclined surface, the jig 55 may be slantedly inserted into the cavity 36, as depicted in FIG. 13A. A first bonding process may be performed in which the COF 24 may be bonded to the first terminal placement surface 549*a* by pressing the COF 24 against the first terminal placement surface 549*a* in a direction normal to the first terminal placement surface 549*a* using the jig 55. For the second terminal placement surface 549*b* parallel to the vibration plate 40, the jig 55 may be inserted into the cavity 36 in the vertical direction, as depicted in FIG. 13B. A second bonding process may be performed in which the COF 24 may be bonded to the second terminal placement surface 549*b* by pressing the COF 24 against the second terminal placement surface 549*b* in a direction normal to the second terminal placement surface using the jig 55. Thus, the COF 24 may be reliably bonded to each of the terminal placement surfaces 549*a*, 549*b* that may have different inclination or shape. As depicted in FIGS. 13A and 13B, bonding of the COF 24 onto the first terminal placement surface 549*a* and the second terminal placement surface 549*b* may be performed by two processes. In another embodiment, bonding of the COF 24 onto the terminal placement surfaces 549*a*, 549*b* may be performed at one time using a jig that may comprise two pressing surfaces configured to press against each of the terminal placement surfaces 549*a*, 549*b* at one time.

A member used to form the terminal placement surface 549 and a shape of the member forming the terminal placement surface 549 may be modified, such that additional embodiments exist. Example ones of those embodiments are further described below, and in connection with FIGS. 14-19.

Sixth Example Modification

Figure 14:
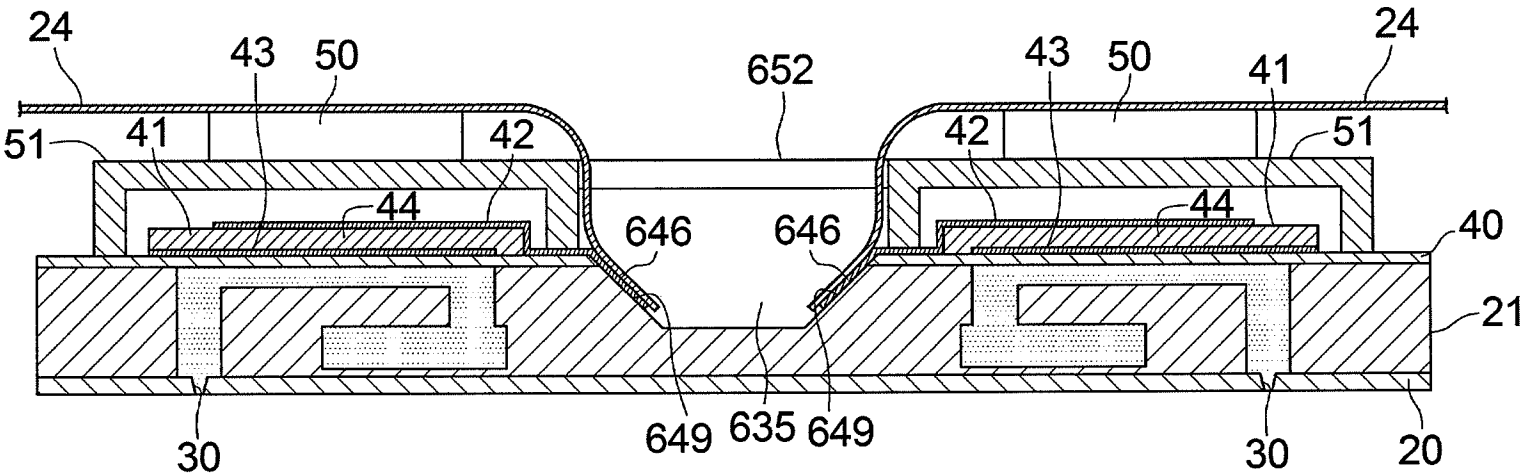
FIG. 14 is a cross-sectional view of an inkjet head according to a sixth example modification.

In a sixth example modification as depicted in FIG. 14, a wall portion 53 of the cover member 23 is omitted, such that a recess portion 635 formed in the channeled member 21 might not be divided into the two cavities 36. In the sixth example modification in which the wall portion 53 is omitted an area of the opening of the recess portion 635 may be increased. Therefore, in such a configuration, the jig 55 may be readily inserted into the recess portion 635.

Seventh Example Modification

Figures 15A, 15B:
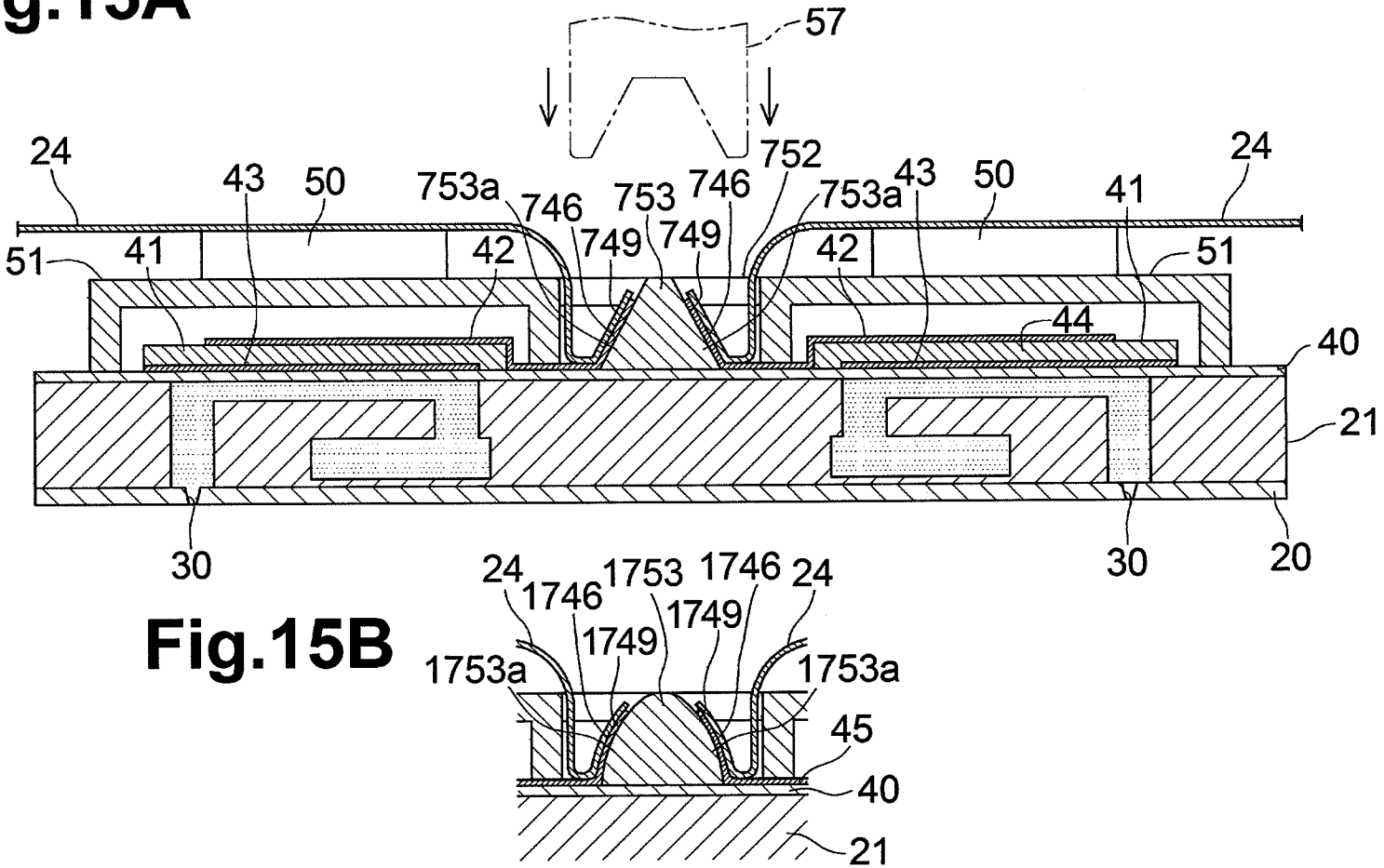
FIGS. 15A and 15B are cross-sectional views of an inkjet head according to a seventh example modification.

In a seventh example modification, a terminal placement surface 49 is provided on a wall portion 753 of the cover member 23 that may define the two cavities 36. For example, as depicted in FIG. 15A, the wall portion 753 may be disposed at a surface 740*a* of the vibration plate 40. The wall portion 753 may extend along a direction in which the piezoelectric elements 44 may be arranged (e.g., the nozzle arrangement direction), to divide the two arrays of the piezoelectric elements 44. The wall portion 753 may comprise two side portions 753*a* whose surfaces may be inclined. When the cover member 23 does not comprise the wall portion 753, as depicted in FIG. 15A, a connecting portion 752 might not have to connect the seal portions 51 configured to cover the respective arrays of the piezoelectric elements 44. The separate seal portions 51 may be provided.

As depicted in the example of FIG. 15B, surfaces of side portions 1753*a* of a wall portion 1753 are curved. In FIG. 15B, a cross section of the wall portion 1753 has a semi-elliptic shape. In another embodiment, a cross section of the wall portion 1753 may have, for example, a semicircular shape (e.g., a shape of a half of a circle). In the seventh example modification, the side portion 1753*a* of the wall portion 1753 may refer to a portion of the wall portion 1753 disposed on each side thereof with respect to a vertical plane including the apex.

A surface of the side portion 1753*a* provided on the inclined surface (or the curved surface) may serve as a terminal placement surface 1749. Each array of terminals 1746, 1748 corresponding to the respective array of the piezoelectric elements 44 may be disposed on the respective terminal placement surface 1749. In such a structure, each COF 24 may be bonded to the respective array of the terminals 1746, 1748 disposed on the terminal placement surface 1749 of each side portion 1753*a* of the wall portion 1753, by pressing the COFs 24 at one time against the wall portion 1753 from above using such jig 55 as depicted in FIG. 15A. Thus, the bonding operation may be facilitated. In another embodiment, the COFs 24 may be bonded to the respective terminal placement surfaces 1749 in separate processes by pressing the COFs 24 using such jig 55 as depicted in FIG. 5 against the respective side portions 1753*a* in their normal direction. In the seventh example modification, the channeled member 21 might not comprise the recess portion 35 as in the above-described example embodiment (FIG. 4A), to make the terminal placement surface 1749 inclined or curved.

The terminal placement surface 1749 comprising an inclined surface or a curved surface may be disposed not only at the wall portion 1753 of the cover member 23 but also at a side wall of the seal portion 51 that may enclose or seal the piezoelectric elements 44.

Eighth Example Modification

Figure 16:
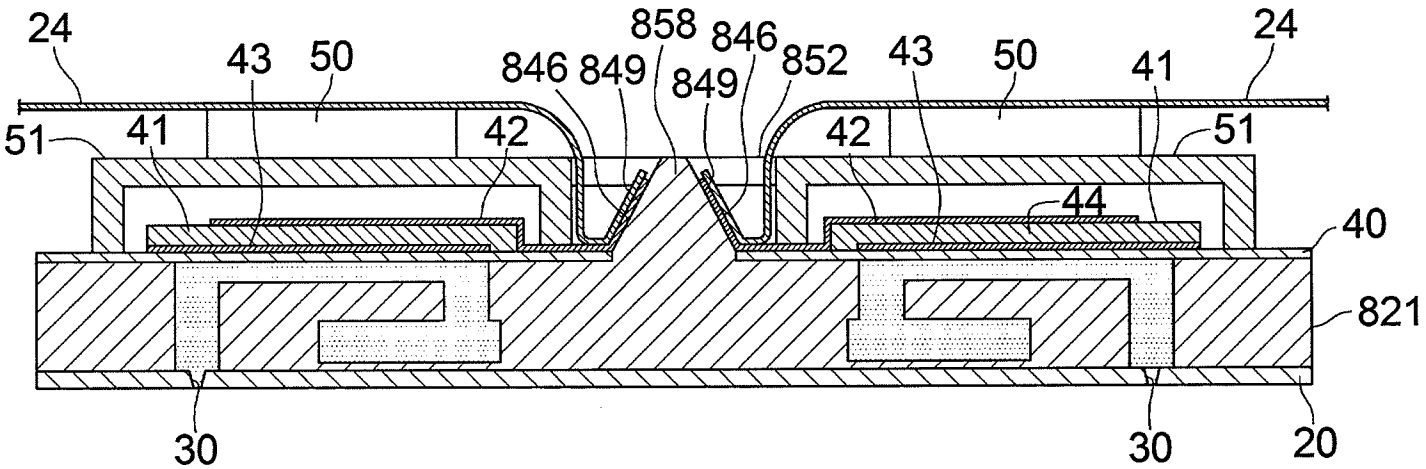
FIG. 16 is a cross-sectional view of an inkjet head according to an eighth example modification.

In an eighth example modification, and as compared to the seventh example modification of FIGS. 14 and 15A-B, a wall disposed to divide the arrays of the piezoelectric elements 44 may be provided at the channeled member 21 or the vibration plate 40. In FIG. 16, a wall portion 858 is shown as provided at the channeled member 21.

Ninth Example Modification

In a ninth example modification, a cover member 23 configured to cover the piezoelectric layer 41 is omitted. In the example shown in FIG. 17, the cover member 23 is omitted from FIG. 16 of the eighth example modification. Unlike the above-described example embodiment, a terminal placement surface 949 in FIG. 17 might not be disposed on an inner wall surface of the recess 35 defined by the channeled member 21 and the cover member 23. A wider space may be provided around the terminal placement surface 949, so that the COF 24 may be readily pressed against the terminal placement surface 949 including an inclined surface (or a curved surface). In another embodiment, the recess portion 35 at which the terminal placement surface 949 is disposed may be provided only in the channeled member 21. When the recess portion 35 is provided only in the channeled member 21, such a jig insertion portion as depicted in FIG. 5 may be provided at a portion of the channeled member 21 that may define an edge of the opening of the recess portion 35.

Figure 17:
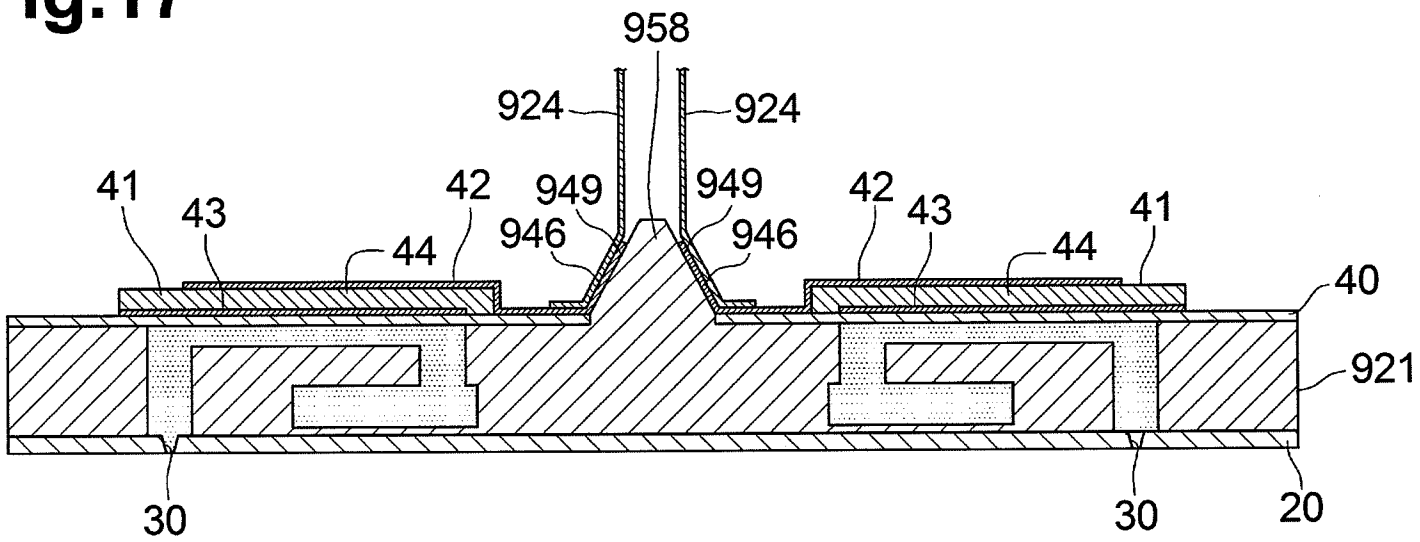
FIG. 17 is a cross-sectional view of an inkjet head according to a ninth example modification.
Figure 18A:
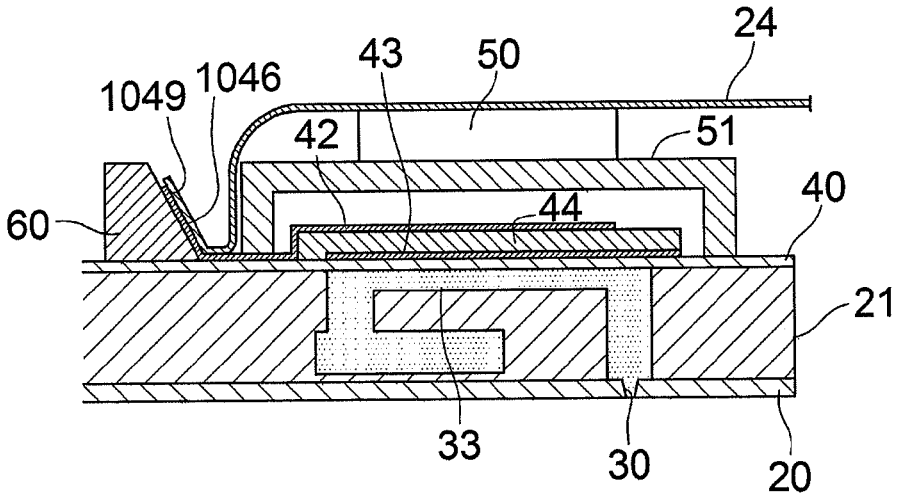
FIGS. 18A and 18B are cross-sectional views of an inkjet head according to a tenth example modification.
Figure 18B:
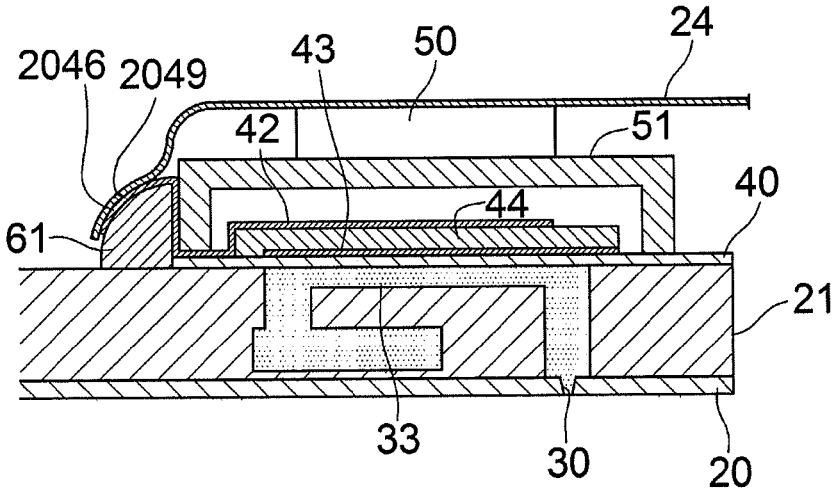

In the examples of FIGS. 15-17, the terminal placement surface 949 may be disposed above the vibration plate 40, e.g., at a position opposite to the pressure chambers 33 with respect to the vibration plate 40 in the direction perpendicular to the vibration plate 40. Therefore, the COF 24 may be more readily bonded to the terminal placement surface 949, as compared with a structure, as depicted in FIG. 4A, in which the terminal placement surface 949 may be disposed on the side of the pressure chambers 33.

Tenth Example Modification in a tenth example modification, a terminal placement surface 1049 may be provided separately from the channeled member 21 or the vibration plate 40. As depicted in the example shown in FIG. 18A, a projection 60 comprising an inclined surface may be attached to the surface 1040*a* of the vibration plate 40. The inclined surface may serve as the terminal placement surface 1049. As depicted in the example shown in FIG. 18B, a projection 61 including a curved surface is attached to the upper surface of the channeled member 21. The curved surface may serve as a terminal placement surface 2049. Thus, when the terminal placement surface 2049 is provided separately from the channeled member 21 or the vibration plate 40, the terminal placement surface 2049 may be formed in various shapes without being subjected to restrictions of, for example, shapes of the channeled member 21 or the vibration plate 40. Therefore, the terminal placement surface 2049 may have a high degree of flexibility in its shape.

Eleventh Example Modification

In an eleventh example modification, a drive element disposed at the vibration plate 40 is not be limited to the piezoelectric element 44. In another embodiment, the drive element may include, for example, a thermal expansion element configured to expand with heat so as to deform the vibration plate 40.

Twelfth Example Modification

Figure 19:
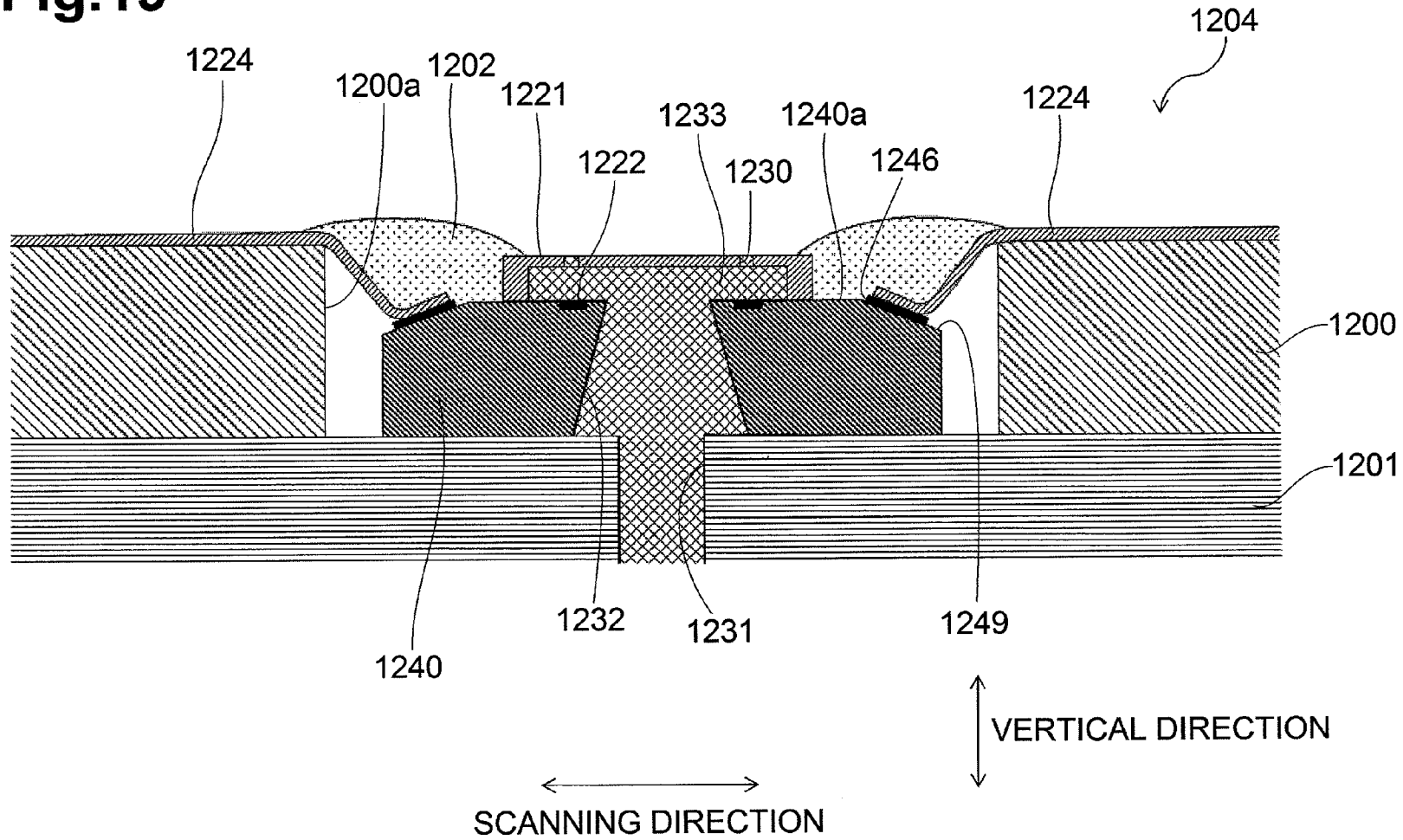
FIG. 19 is a cross-sectional view of an inkjet head according to a twelfth example modification.

In still further example modifications, the features of the present disclosure may be applied to other inkjet head configurations. For example, configurations may be used that eject ink using bubble formation within the pressure chamber(s) of an inkjet head 4 to eject ink, in addition to those disclosed above in which the inkjet head 4 is configured to eject ink by driving the piezoelectric elements 44. As depicted in the example of FIG. 19, an inkjet head 1204 includes a channeled member 1221 and a silicon substrate 1240. The channeled member 1221 as shown includes nozzles 1230 configured to eject ink therefrom and pressure chambers 1233 configured to fluidly communicate with the nozzles 1230. The silicon substrate 1240 may be connected to the channeled member 1221 to cover the pressure chambers 1233. In such embodiments, the silicon substrate 1240 may include a manifold 1232 configured to fluidly communicate with the pressure chambers 1233. The silicon substrate 1240 may include a surface 1240*a* that may extend in the scanning direction. The channeled member 1221 may be connected to the surface 1240*a*. The inkjet head 1204 may further comprise a base plate 1201 and a support plate 1200. The base plate 1201 may be connected to the silicon substrate 1240. The base plate 1201 may have an ink supply opening 1231 configured to be fluidly communicate with the manifold 1232. The support plate 1200 may be connected to the base plate 1201. The support plate 1200 may have an opening 1200*a* in which the channeled member 1221 and the silicon substrate 1240 may be disposed.

The silicon substrate 1240 may comprise heaters 1222 that may oppose the nozzles 1230 in the vertical direction, terminals 1246 configured to electrically connect to the heaters 1222 and a terminal placement surface 1249 at which the terminals 1246 may be disposed. In this example embodiment, the heaters 1222 may correspond to example embodiments of drive elements, as that term is used herein. In some such embodiments, the terminal placement surface 1249 is inclined with respect to the surface 1240*a*. A chip on film ("COF") 1224 may be disposed on the support plate 1200. A portion of the COF 1224 may be bonded to the terminals 1246. A sealing agent 1202 may cover the portion where the COF 1224 and the terminals 1246 may be connected.

In such embodiments, as a voltage is applied via the COF 1224 and the terminals 1246, the heater 1222 generates bubbles in ink in the pressure chambers 1233 opposing the heater 1222 in the vertical direction to eject ink from the nozzles 1230.

In another embodiment, the terminal placement surface 1249 may include an inclined surface that may extend upward from the channeled member 1221 toward the support plate 1200.

In the above-described embodiment and the example modifications, disclosure may be applied to an inkjet printer configured to eject ink onto a sheet to print, for example, an image. In another embodiment, disclosure may be applied to liquid ejection apparatuses that may have different usages than the image printing. For example, disclosure may be applied to a liquid ejection apparatus configured to eject a conductive liquid onto a substrate to form conductive patterns on a surface of the substrate. Furthermore, although the invention has been described based on example embodiments and variations, the embodiments of the invention facilitate the understanding of the invention and do not limit the invention. The invention can be changed or modified without departing from the spirit of the invention and the scope of the claims and the invention includes the equivalents thereof

What is claimed is:

1. A liquid ejection apparatus, comprising:

a channel unit comprising a liquid channel including a plurality of nozzles and a plurality of pressure chambers configured to communicate with respective nozzles;

a plate provided on the channel unit to cover the plurality of the pressure chambers in a first direction from the pressure chambers, the plate comprising a plate surface extending along a second direction perpendicular to the first direction;

a plurality of drive elements arranged over the plate in correspondence with the plurality of the pressure chambers;

a plurality of contact terminals electrically connected in correspondence with respective drive elements, the plurality of the contact terminals are provided at a terminal placement surface, wherein the terminal placement surface is non-parallel with the plate surface and includes at least a portion of the terminal placement surface that is offset from the plate surface; and a flexible wiring board configured to be electrically connected to the plurality of the contact terminals.

2. The liquid ejection apparatus according to claim 1, wherein the terminal placement surface comprises a planar inclined surface extending from the plate surface.

3. The liquid ejection apparatus according to claim 1, wherein the terminal placement surface comprises a curved surface.

4. The liquid ejection apparatus according to claim 1, wherein the plurality of pressure chambers are fluidically connected to respective nozzles.

5. The liquid ejection apparatus according to claim 1, further comprising:

a second terminal placement surface continued from the terminal placement surface, the second terminal placement surface being parallel to the plate surface, wherein each of the plurality of the contact terminals comprises a first contact terminal and a second contact terminal; and the first contact terminal is arranged on the terminal placement surface, and the second contact terminal is arranged on the second terminal placement surface.

6. The liquid ejection apparatus according to claim 5, wherein each of the terminal placement surface and the second terminal placement surface extends along the second direction;

the terminal placement surface comprises an end portion which is disposed at one end of the terminal placement surface in a third direction intersecting both the first direction and the second direction, and the end portion adjacent to the second terminal placement surface;

the terminal placement surface has an inclined shape which is inclined with respect to the third direction; and a plurality of first contact terminals and a plurality of second contact terminals are arranged in a zigzag manner along the second direction.

7. The liquid ejection apparatus according to claim 5, wherein the flexible wiring board comprises a first flexible wiring portion joined to a plurality of first contact terminals, and a second flexible wiring portion joined to a plurality of second contact terminals.

8. The liquid ejection apparatus according to claim 5, further comprising a wire arranged at the plate, wherein each of the plurality of drive elements comprises a first electrode to which a driving signal is supplied from the flexible wiring board, and a second electrode that is kept at a predetermined reference potential, and the first contact terminal electrically connects to the first electrode via the wire, and the second contact terminal electrically connects to the second electrode via the wire.

9. The liquid ejection apparatus according to claim 4, wherein a distance between the terminal placement surface and the nozzle in the first direction is greater than a distance between the second terminal placement surface and the nozzle in the first direction.

10. The liquid ejection apparatus according to claim 1, wherein the terminal placement surface is opposite to the pressure chamber with respect to the plate in the first direction.

11. The liquid ejection apparatus according to claim 1, wherein the plurality of the drive elements form a drive element array aligned along the second direction, the liquid ejection apparatus further comprising a wall portion arranged adjacent to the drive element array in a third direction intersecting both the first direction and the second direction, and the wall portion comprises the inclined surface or the curved surface.

12. The liquid ejection apparatus according to claim 11, wherein a plurality of the drive element arrays are arranged in the third direction, and the wall portion is arranged between the plurality of the drive element arrays in the third direction.

13. The liquid ejection apparatus according to claim 12, wherein the plurality of the plurality of the contact terminals form a contact terminal array aligned along the second direction, wherein the wall portion comprises two side walls, each extending in the second direction, the two side walls are offset from the plate surface in the third direction, the two walls being non-parallel with the plate surface and each including at least a portion that is offset from the plate surface, and wherein the contact terminal array is at least partially disposed on at least one of the two side walls.

14. The liquid ejection apparatus according to claim 12, wherein the wall portion is integrally formed with the channel unit.

15. The liquid ejection apparatus according to claim 1, wherein the channel unit comprises a recess that is aligned with the drive elements in the second direction, and has an inner surface, and wherein the contact terminal array is at least partially disposed on the inner surface.

16. The liquid ejection apparatus according to claim 15, wherein the channel unit includes an opening to the recess and a border portion that is disposed at an edge of the opening, and wherein the channel unit includes a wall portion including a border portion, the border portion positioned to avoid intersection of the wall portion by at least one virtual line extending normal to the terminal placement surface.

17. The liquid ejection apparatus according to claim 16, wherein the border portion extends parallel with the at least one virtual line, and is inclined with respect to the plane surface.

18. The liquid ejection apparatus according to claim 1, further comprising a cover portion configured to cover the plurality of the drive elements, wherein each of the elements comprises a piezoelectric element;

wherein the channel unit and the cover portion define a recess that is aligned with the drive element in the second direction, and has an inner surface, and at least a part of the inner surface comprises the terminal placement surface.

19. The liquid ejection apparatus according to claim 18, wherein the cover portion includes an opening to the recess, and a border portion that is disposed at an edge of the opening, and wherein the cover portion includes a wall portion including the border portion, wherein the border portion is positioned to avoid intersection of the wall portion by at least one virtual line extending normal to the terminal placement surface.

20. The liquid ejection apparatus according to claim 19, wherein the border portion extends parallel with the at least one virtual line, and is inclined with respect to the plane surface.

21. The liquid ejection apparatus according to claim 1, wherein the terminal placement surface further comprises a projection portion which projects from the plate surface in the first direction, the projection portion being formed of a member configured to separate from the channel unit and the plate.

22. The liquid ejection apparatus according to claim 1, wherein the flexible wiring board and the plurality of the contact terminals arranged on the terminal placement surface are bonded by an anisotropic conductive adhesive.

23. The liquid ejection apparatus according to claim 1, wherein the plate is a vibration plate, and the plurality of the drive elements are opposite to the pressure chamber with respect to the vibration plate in the first direction.

24. The liquid ejection apparatus according to claim 1, wherein the channel unit includes the terminal placement surface.

25. A method for connecting a flexible wiring board to a liquid ejection apparatus, the method comprising:

connecting a flexible wiring board to each of a plurality of the contact terminals disposed on a terminal placement surface such that the flexible wiring board is pressed against the terminal placement surface in a direction normal to the terminal placement surface;

wherein the terminal placement surface is non-parallel with a plate surface of a plate provided on a channel unit and includes at least a portion of the terminal placement surface that is offset from the plate surface, wherein the channel unit including a plurality of nozzles and a plurality of pressure chambers and wherein each of the plurality of contact terminals are electrically connected to corresponding drive elements arranged over the plate in correspondence with the plurality of pressure chambers.

26. The method according to claim 25, the method further comprising:

connecting the flexible wiring board to a second terminal placement surface such that the flexible wiring board is pressed against the second terminal placement surface in a direction normal to the second terminal placement surface, the second terminal placement surface extending from the terminal placement surface in a direction parallel to the plate surface.

27. A printer comprising:

a liquid ejection apparatus, the liquid ejection apparatus including:

a channel unit comprising a liquid channel including a plurality of nozzles and a plurality of pressure chambers configured to communicate with respective nozzles;

a plate provided on the channel unit to cover the plurality of the pressure chambers in a first direction from the pressure chambers, the plate comprising a plate surface extending along a second direction perpendicular to the first direction;

a plurality of drive elements arranged over the plate in correspondence with the plurality of the pressure chambers;

a plurality of contact terminals electrically connected in correspondence with respective drive elements, the plurality of the contact terminals are provided at a terminal placement surface, wherein the terminal placement surface is non-parallel with the plate surface and includes at least a portion of the terminal placement surface that is offset from the plate surface; and a flexible wiring board configured to be electrically connected to the plurality of the contact terminals.

* * * * *